US007784897B2

(12) United States Patent
Fletcher et al.

(10) Patent No.: US 7,784,897 B2
(45) Date of Patent: Aug. 31, 2010

(54) METHOD OF MEASURING PRINTING CHARACTERISTICS

(75) Inventors: Peter Alleine Fletcher, Rozelle (AU); Kieran Gerard Larkin, Putney (AU)

(73) Assignee: Canon Kabushiki Kaisha, Tokyo (JP)

( * ) Notice: Subject to any disclaimer, the term of this patent is extended or adjusted under 35 U.S.C. 154(b) by 223 days.

(21) Appl. No.: 12/146,414

(22) Filed: Jun. 25, 2008

(65) Prior Publication Data

US 2009/0021552 A1 Jan. 22, 2009

(30) Foreign Application Priority Data

Jul. 17, 2007 (AU) ..... 2007203295

(51) Int. Cl.
*B41J 29/393* (2006.01)

(52) U.S. Cl. ..... 347/19

(58) Field of Classification Search ..... 347/12, 347/15, 19; 358/1.2, 1.9, 504
See application file for complete search history.

(56) References Cited

U.S. PATENT DOCUMENTS 5,250,956 A 10/1993 Haselby et al.
6,158,344 A 12/2000 Walker et al.
6,354,689 B1 * 3/2002 Couwenhoven et al. ..... 347/19
6,491,373 B1 * 12/2002 Fujita et al. ..... 347/41
6,739,699 B1 * 5/2004 Sender et al. ..... 347/43
7,377,613 B2 * 5/2008 Yamazaki et al. ..... 347/19
2005/0083364 A1 4/2005 Billow

* cited by examiner

*Primary Examiner*—Lamson D Nguyen
(74) *Attorney, Agent, or Firm*—Fitzpatrick, Cella, Harper & Scinto

(57) ABSTRACT

A method (300) is described of determining characteristic of an ink jet printer (15). A chart containing multiple regions or patches is printed (320) on a print medium (115) using the ink jet print (15). The chart includes at least a first region printed using a first set of nozzles, and at least a second region printed using a second set of nozzles. The first and second sets of nozzles are a predetermined distance apart in the printer head of the printer (15). The printing of the first and second regions is also separated by a print medium advance operation equal to the predetermined distance. This causes the first and second regions to be aligned in the direction of the print medium advance operation. The chart is then imaged using scanner (16) chart to form a chart image. The positions of the regions appearing in the chart image are next determined (340). The spatial alignment characteristic of the printer is calculated from the distance, in the medium advance direction, between said first and second regions.

6 Claims, 26 Drawing Sheets

METHOD OF MEASURING PRINTING CHARACTERISTICS

CROSS-REFERENCE TO RELATED APPLICATIONS

This application claims the right of priority under 35 U.S.C. §119 based on Australian Patent Application No. 2007203295, filed 17 Jul. 2007, which is incorporated by reference herein in its entirety as if fully set forth herein.

FIELD OF THE INVENTION

The current invention relates generally to printer calibration and, in particular, to a method including analysing an image printed by an printer in order to determines spatial characteristics of the printer.

BACKGROUND

In recent years high quality colour printers has became a norm. Two significant and related factors led to such being the norm, namely improvements in accuracy in colour reproduction and improvements in resolution. For ink jet printers, typical resolutions are 1200 dpi or higher, which translates into a printer ink dot size (and separation) of 20 microns or less. In many systems the ink jet printer may overprint regions multiple times to help minimise the effect of printer defects, such as blocked printer head nozzles. The optical density of a printed colour can be very sensitive to the precise value of the displacement between overprinted regions. This means that (for high quality at least) it is necessary to control or calibrate the exact displacement of the printer head between overprints.

Many approaches have been proposed for calibrating the movements of the printer head relative to the medium being printed on in a precise manner. The main approaches can be summaries as follows:

- Measure (using the human eye, or more recently an optical sensor) optical density of an overlapping, interlaced dot pattern (also known as complementary dot patterns);
- Measure alignment of a series of lines (visually inspection using the Vernier effect);
- Measure alignment of an interlaced series of lines (Vernier effect using optical sensor); and
- Measure (using a scanner) individual positions of sparse, but regular arrays of dots.

Until recently the visually based methods have dominated so completely that visual inspection is assumed and is not usually mentioned explicitly. The more recent automatic methods are typically just simple modifications of the visual methods to allow simple optical sensors to monitor spatial variations in optical density. Measurement of individual dot positions, although fundamental, is quite unreliable due to the large variations in dot shape, position and size. There is also the difficulty of unambiguously locating isolated dots in large regions on the medium being printed upon.

With these weaknesses in the prior art methods in mind it is beneficial to consider more general and robust approaches to measurement.

SUMMARY

It is an object of the present invention to substantially overcome, or at least ameliorate, one or more disadvantages of existing arrangements.

According to an aspect of the present invention there is provided a method of measuring print accuracy of a print mechanism of a printer, the method comprising the steps of:

printing a chart on a print medium using said print mechanism, said chart comprising:

at least a first and a second region printed using first and second sets of nozzles respectively, said first and second sets of nozzles being a predetermined distance apart; and at least a third region printed using said first set of nozzles, wherein the printing of said first and second regions, and the printing of said third region, are separated by a print medium advance operation, and each region comprising a spread spectrum pattern;

imaging said chart to form a chart image;

determining the positions of said regions appearing in said chart image; and calculating the accuracy of the print mechanism of the printer using said predetermined distance, the distance in the direction of said print medium advance operation between said first and second regions, and the distance in the direction of said print medium advance operation between said first and third regions.

According to another aspect of the present invention there is provided an apparatus for measuring print accuracy of a print mechanism of a printer, the apparatus comprising:

means for printing a chart on a print medium using said print mechanism, said chart comprising:

at least a first and a second region printed using first and second sets of nozzles respectively, said first and second sets of nozzles being a predetermined distance apart; and at least a third region printed using said first set of nozzles, wherein the printing of said first and second regions, and the printing of said third region, are separated by a print medium advance operation, and each region comprising a spread spectrum pattern;

means for imaging said chart to form a chart image;

means for determining the positions of said regions appearing in said chart image; and means for calculating the accuracy of the print mechanism of the printer using said predetermined distance, the distance in the direction of said print medium advance operation between said first and second regions, and the distance in the direction of said print medium advance operation between said first and third regions.

According to still another aspect of the present invention there is provided a computer readable storage medium, having a program recorded thereon, where the program is configured to make a computer execute a procedure of measuring print accuracy of a print mechanism of a printer, the program comprising:

code for printing a chart on a print medium using said print mechanism, said chart comprising:

at least a first and a second region printed using first and second sets of nozzles respectively, said first and second sets of nozzles being a predetermined distance apart; and at least a third region printed using said first set of nozzles, wherein the printing of said first and second regions, and the printing of said third region, are separated by a print medium advance operation, and each region comprising a spread spectrum pattern;

code for imaging said chart to form a chart image;

code for determining the positions of said regions appearing in said chart image; and code for calculating the accuracy of the print mechanism of the printer using said predetermined distance, the distance in the direction of said print medium advance operation between said first and second regions, and the distance in the direction of said print medium advance operation between said first and third regions.

Other aspects of the invention are also disclosed.

BRIEF DESCRIPTION OF THE DRAWINGS

One or more embodiments of the present invention will now be described with reference to the drawings, in which.

DETAILED DESCRIPTION

Figure 1:
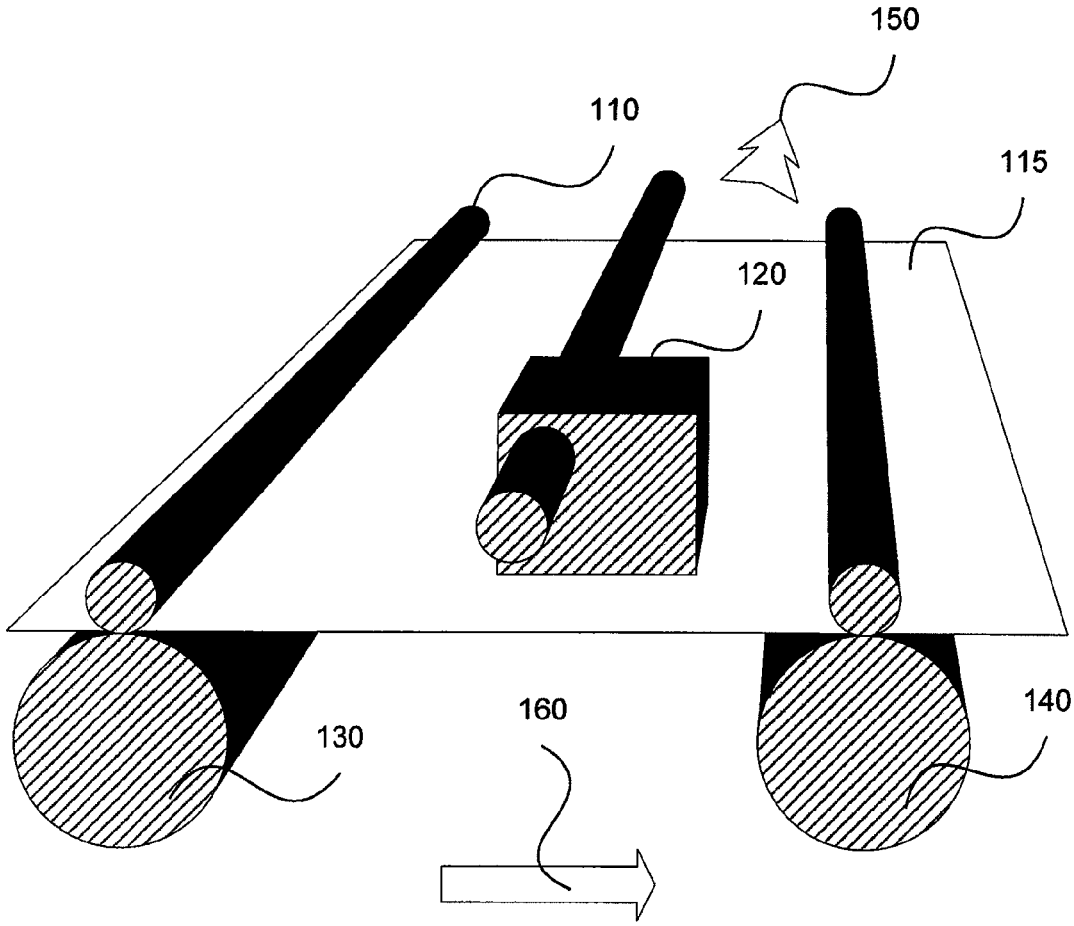
FIG. 1 shows a simplified representation of the mechanical layout of an ink jet printer.

Where reference is made in any one or more of the accompanying drawings to steps and/or features, which have the same reference numerals, those steps and/or features have for the purposes of this description the same function(s) or operation(s), unless the contrary intention appears.

Methods are described of measuring the spatial characteristics of an ink jet printer using relative position estimation of printed noise patches (or regions), and the design of these patches so as to enable accurate estimates based on cross-correlation.

FIG. 1 shows a simplified representation of the internal arrangement of an ink jet printer. The arrangement comprises a print head 120 having ink ejection nozzles (not illustrated) organised into groups based on colour and/or ink volume. The print head 120 is mounted on a carriage 125 which transverses a print medium 115 and forms image swaths during a forward passage in a scan direction 150 and a back passage opposite to the scan direction 150, by controlling the ejection of ink from the ink ejection nozzles within the nozzle groups.

Figure 2:
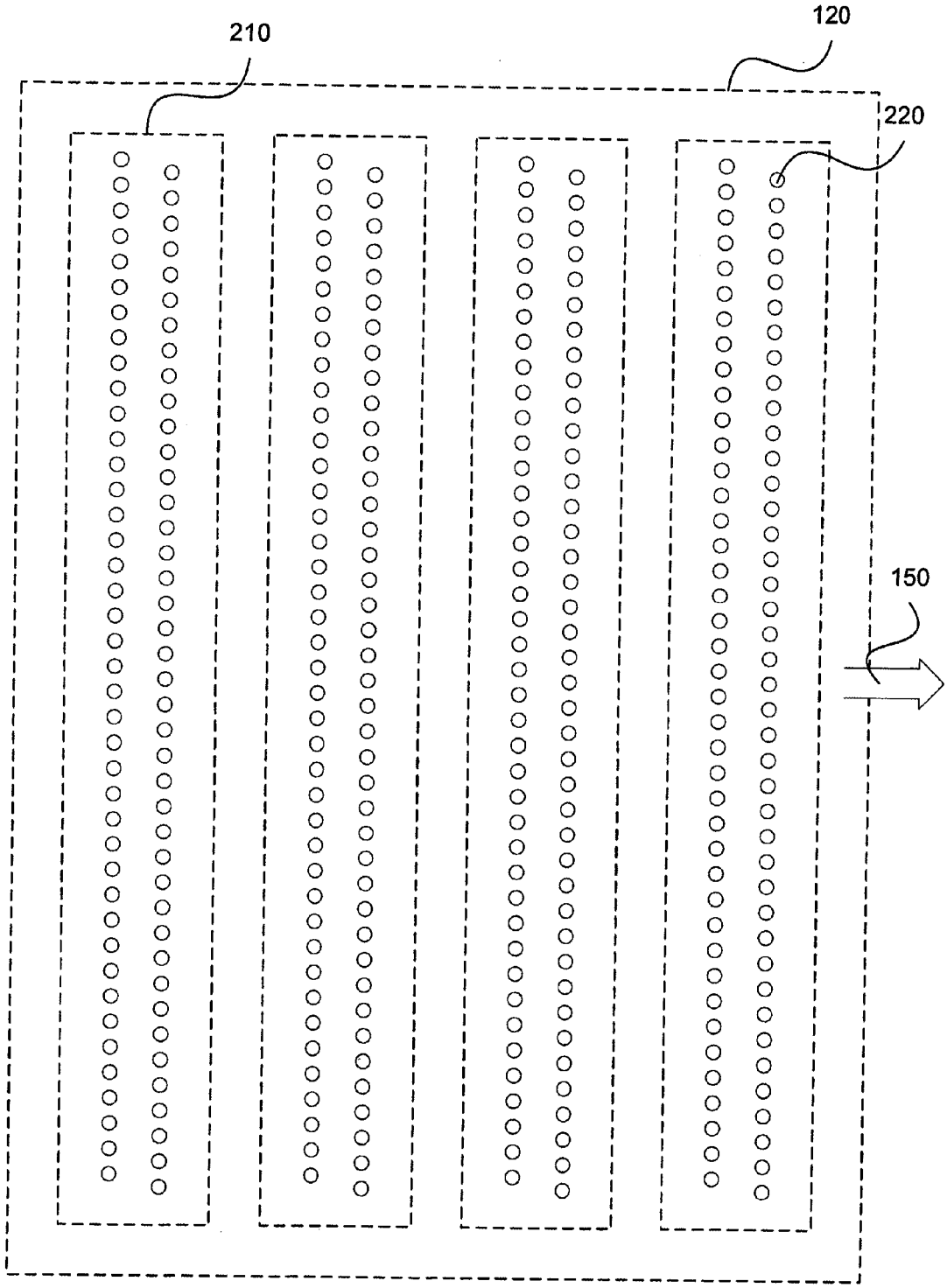
FIG. 2 shows a typical layout of ink ejection nozzles of an ink jet print head.

FIG. 2 shows the typical layout of the ink eject nozzle groups 210 of the print head 120. Each nozzle group 210 consists of multiple ink ejection nozzles 220 extending perpendicular to the print head scan direction 150. Referring again to FIG. 1, the ink jet printer further comprises a print medium feed mechanism 130 and 140, which transports the print medium 115 in a direction 160 perpendicular to the print head scan direction 150.

In order for an ink jet printer to produce images which do not contain noticeable visual artefacts, alignment is required between the nozzle groups 210 used within the same passage, and between the nozzle groups 210 used during the forward and back passages respectively. The print medium feed mechanism 130 and 140 must also be calibrated to feed the print medium 115 in order to correctly align swaths. Manufacturing tolerances for the rollers which make up the print medium feed mechanism 130 and 140, the motors (not illustrated) which drive the print head 120 and print medium feed rollers 130 and 140, and the mounting of parts within the system mean calibration cannot entirely take place during design. To produce optimal image quality it is necessary to characterise each individual printing system, and calibrate components of that printing system accordingly.

Figure 3:
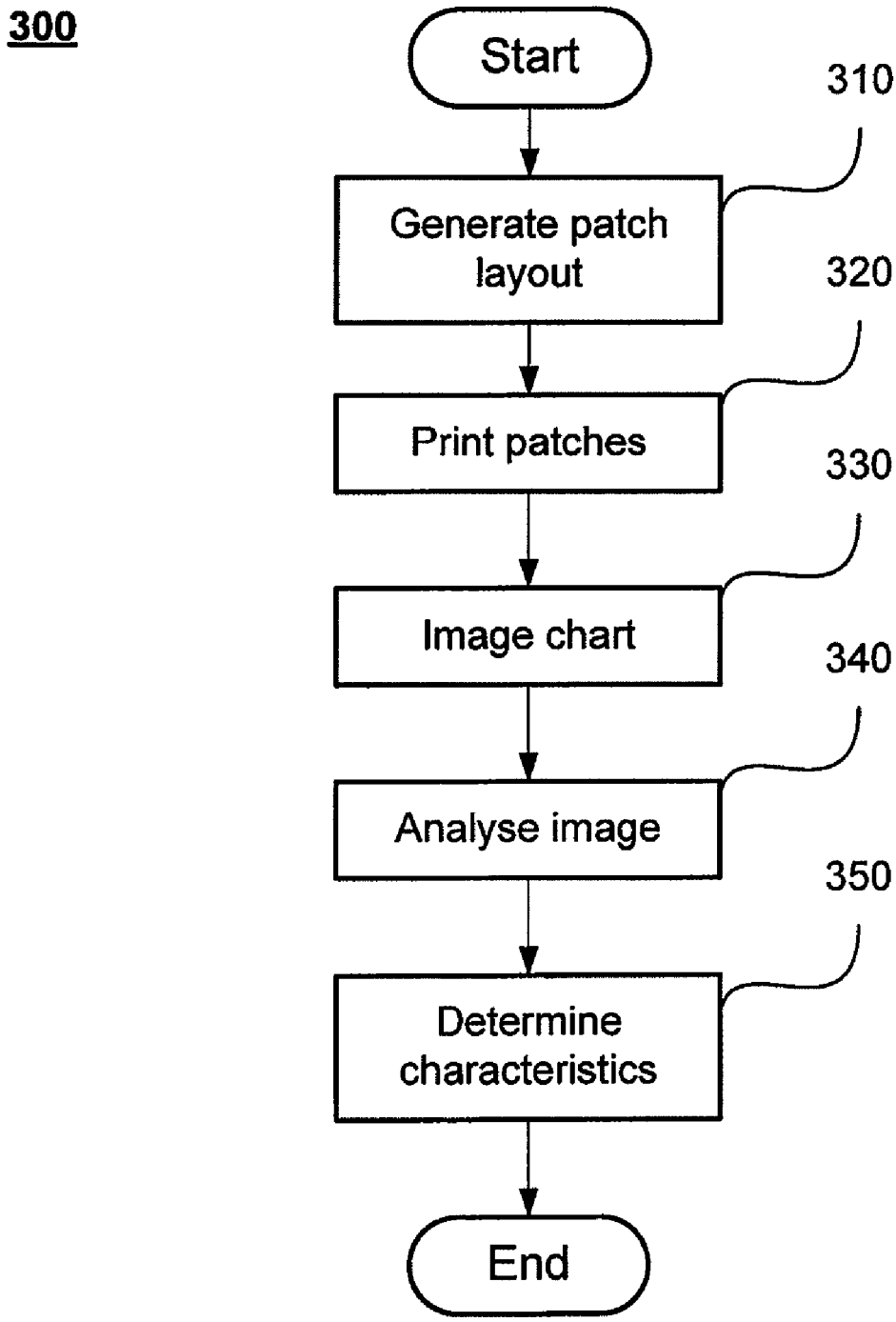
FIG. 3 is a schematic flow diagram of a method of determining characteristics of the printing mechanism of an ink jet printer.

FIG. 3 shows a schematic flow diagram of a method 300 of determining characteristics of the printing mechanism of an ink jet printer. The characteristics may be used to diagnose or calibrate the printing mechanism.

Figure 26:
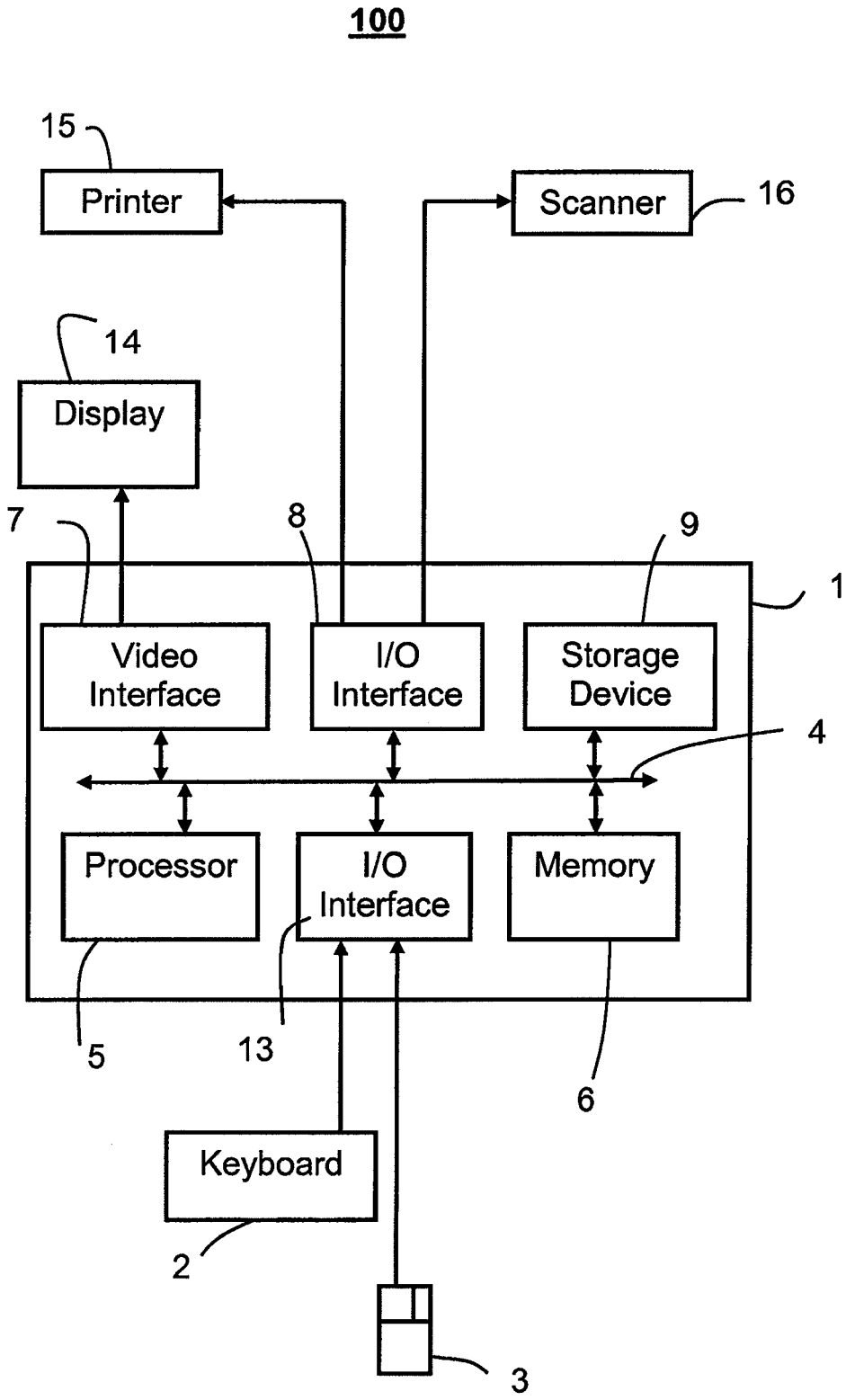
FIG. 26 shows a schematic block diagram of a computer system upon which the processes of FIG. 3 may be implemented.

The method 300 of determining characteristics of the printing mechanism of an ink jet printer may be implemented using a computer system 100, such as that shown in FIG. 26 wherein the processes of FIG. 3 may be implemented as software. The software may be stored in a computer readable medium, is loaded into the computer system 100 from the computer readable medium, and then executed by the computer system 100. A computer readable medium having such software or computer program recorded on it is a computer program product. The use of the computer program product in the computer system 100 preferably effects an advantageous apparatus for determining characteristics of the printing mechanism of an ink jet printer.

The computer system 100 is formed by a computer module 1, input devices such as a keyboard 2, a mouse pointer device 3, and a scanner 16, and output devices including an ink jet printer 15, and a display device 14. The computer module 1 typically includes at least one processor unit 5, a memory unit 6, and an number of input/output (I/O) interfaces including a video interface 7 that couples to the video display 14, an I/O interface 13 for the keyboard 2 and mouse 3, and an interface 8 for the scanner 16 and the ink jet printer 15. In some implementations, the scanner 16 and ink jet printer 15 may be incorporated within a joint device.

The interfaces 8 and 13 may afford both serial and parallel connectivity, the former typically being implemented according to the Universal Serial Bus (USB) standards and having corresponding USB connectors (not illustrated). Storage devices 9 are also provided, and typically include at least a hard disk drive (HDD). Other storage devices such as a floppy disk drive and a magnetic tape drive (not illustrated) may also be used. An optical disk drive may also be provided to act as a non-volatile source of data. Portable memory devices, such optical disks (eg: CD-ROM, DVD), USB-RAM, and floppy disks for example may then be used as appropriate sources of data to the system 100.

The components 5 to 13 of the computer module 1 typically communicate via an interconnected bus 4 and in a manner which results in a conventional mode of operation of the computer system 100 known to those in the relevant art.

Typically, the software discussed above is resident on the hard disk drive (HDD) and is read and controlled in execution by the processor 5. Intermediate storage of such software may be accomplished using the memory 6, possibly in concert with the hard disk drive. In some instances, the software may be supplied to the user encoded on one or more CD-ROM. Still further, the software can also be loaded into the system 100 from other computer readable media. Computer readable media refers to any storage medium that participates in providing instructions and/or data to the system 100 for execution and/or processing. Examples of such media include floppy disks, magnetic tape, CD-ROM, a hard disk drive, a ROM or integrated circuit, a magneto-optical disk, or a computer readable card such as a PCMCIA card and the like, whether or not such devices are internal or external of the computer module 1. Examples of computer readable transmission media that may also participate in the provision of instructions and/or data include radio or infra-red transmission channels as well as a network connection to another computer or networked device, and the Internet or Intranets including e-mail transmissions and information recorded on Websites and the like.

The method 300 starts in step 310 where a patch layout is generated, with the patch having properties suitable for performing accurate analysis. Step 310 is described in more detail below. Step 320 then follows where a chart is printed on the printing medium 115 using the ink jet printer 15. As is described in more detail below, the chart consists of a plurality of patches according to the generated patch layout.

Next, in step 330, a digital image of the chart is formed by imaging the chart using an imaging device, such as the scanner 16. The processor 5 then, in step 340, analyses the digital chart image in order to locate and determine the displacement between patches in the digital chart image. Finally, in step 350, the patch locations and displacement between patches are used to determine the characteristics of the printing mechanism of the ink jet printer 15.

Having described an overview of the method 300, considerations when defining the patch layout in step 310 is now described. In the field of image alignment an optimal estimate of relative displacement between structure common to two images can be obtained through cross-correlation of the two images. Such is also known as classical matched filtering. The accuracy of displacement estimation is dependent upon both the difference in the two images and the Fourier spectrum of the structure common to the two images. In general it is possible to state that the very best displacement estimation occurs for images with both wide spatial and wide spectral support, namely spread spectrum images. The wide spatial support allows a significant amount of energy (Rayleigh-Parseval-Plancherel theorem) to be contained in the image. The wide spectral support allows a distinct, sharp correlation peak.

A naturally occurring image will have a particular Fourier spectrum associated with it. In contrast, the patch layout generated in step 310 consists of a group of printed ink dots, with the dots being arranged such that the patch has a Fourier spectrum which optimises the correlation peak height and peak width when that patch is correlated with itself (auto-correlation).

Correlation may also be interpreted in terms of statistical estimation theory. When applied to a printer dot position estimation problem, correlation allows measurements based on chosen groups of dots, rather than individual dots. This ensemble approach also has the benefit that ultimately the visual quality of the printer depends on ensemble effects.

A nice property of correlation is that all possible spatial displacements can be evaluated in order NlogN time using the fast Fourier Transform and the Wiener-Khinchin theorem, for images with N pixels. The location of the amplitude peak of the correlation determines the optimal estimate of the relative displacement between the images, or groups of dots in the present case. For a suitably designed group of dots auto-correlation and cross-correlation are highly peaked functions.

The fractional sample (or fractional pixel) position of the peak can be estimated to high accuracy using peak interpolation methods. In the present case where a patch containing groups of dots is used, it is possible to estimate the relative displacement with an accuracy of approximately 0.01 of the dot size itself. Thus cross-correlation potentially allows relative displacement estimation into the sub-micron domain, which is well below the error of the older, visually based calibration methods.

In view of the foregoing, cross-correlation of the patches printed in step 320 is used to reliably measure distances on the printed chart. To get a useful correlation peak, the printed patches have a spread-spectrum characteristic, in which the patch pattern is composed of many spatial frequencies, especially high spatial frequencies.

An example of such a spread-spectrum pattern would be a patch consisting of uniformly distributed random intensities, which has a white spread-spectrum characteristic, with each spatial frequency within the sampling band limit being similarly represented.

The physical processes and characteristics involved in printing the patches place several constraints on the patch pattern. One such characteristic is that printers are inherently binary devices, with each pixel position in a created patch either containing ink, or not. Accordingly, the patch pattern layout generated in step 310 is a binary pattern.

One possible pattern to use would be a patch layout containing pixels based upon a pseudo-random noise function with 50% probability of inked or empty pixel positions, as such a pattern has good spread-spectrum characteristics. There are however several problems with such a patch layout. Printed dots often appear larger on the printing medium 115 than the apparent dot per inch (DPI) specifications of the printer would suggest. This effect is referred to as dot gain, and results in the density of the printed patch being higher than the apparent density in the generated patch layout. For example, a generated patch layout containing a density of 50% pixels containing ink may produce a printed patch appearing fully saturated with ink. For this reason, it would be preferable to generate the patch layout with a density of dots much smaller than 50%.

Another problem to consider when generating the patch layout in step 310 is that both ink jet and electrostatic printers have non-linear behaviour where dots are printed too closely together. In the case of electrostatic printers, dot gain can change depending upon the size of printed dots. With ink jet printers, ink droplets ejected close together may merge in the air, creating a single larger dot instead of two discrete dots.

Printing dots too close together may also cause problems with the print head 120 if the print head 120 is not capable of printing pairs of dots in rapid succession due to heat or timing constraints.

For these reasons it would be preferable to ensure that the dots in the generated patch layout are both of low density and sparse.

Sparseness of dot placement can be achieved by using an error diffusion algorithm, such as Floyd-Steinberg, which is used to convert an image containing specified grey levels into discrete dots of the same local average density as the original grey level image.

Unfortunately for the purposes of generating a patch layout with good correlation characteristics, the Floyd-Steinberg algorithm can generate images containing periodic structures, which do not have good spread-spectrum characteristics for image correlation. The Floyd-Steinberg algorithm also suffers from low density in the top left of a generated image where error values have not accumulated to the extent of producing any inked dots.

To ensure that the dots in the generated patch layout have good correlation characteristics, random noise is added to a uniform density image to perturb the placement of quantized dots. Also, a larger image than required is generated and the low-density region in the top left of the image is cropped out to form the patch.

Due to the non-deterministic nature of these methods, it is possible that some small number of dots may be created which are not compatible with the printing hardware. These dots can be removed in another pass over the image without substantially affecting the density of the generated patch layout.

It can also be useful to annotate the patch with alignment marks to assist the analysis routine, such as extra ink dots in the top line of the patch layout to orient the patch with the top of the page.

Figure 4:
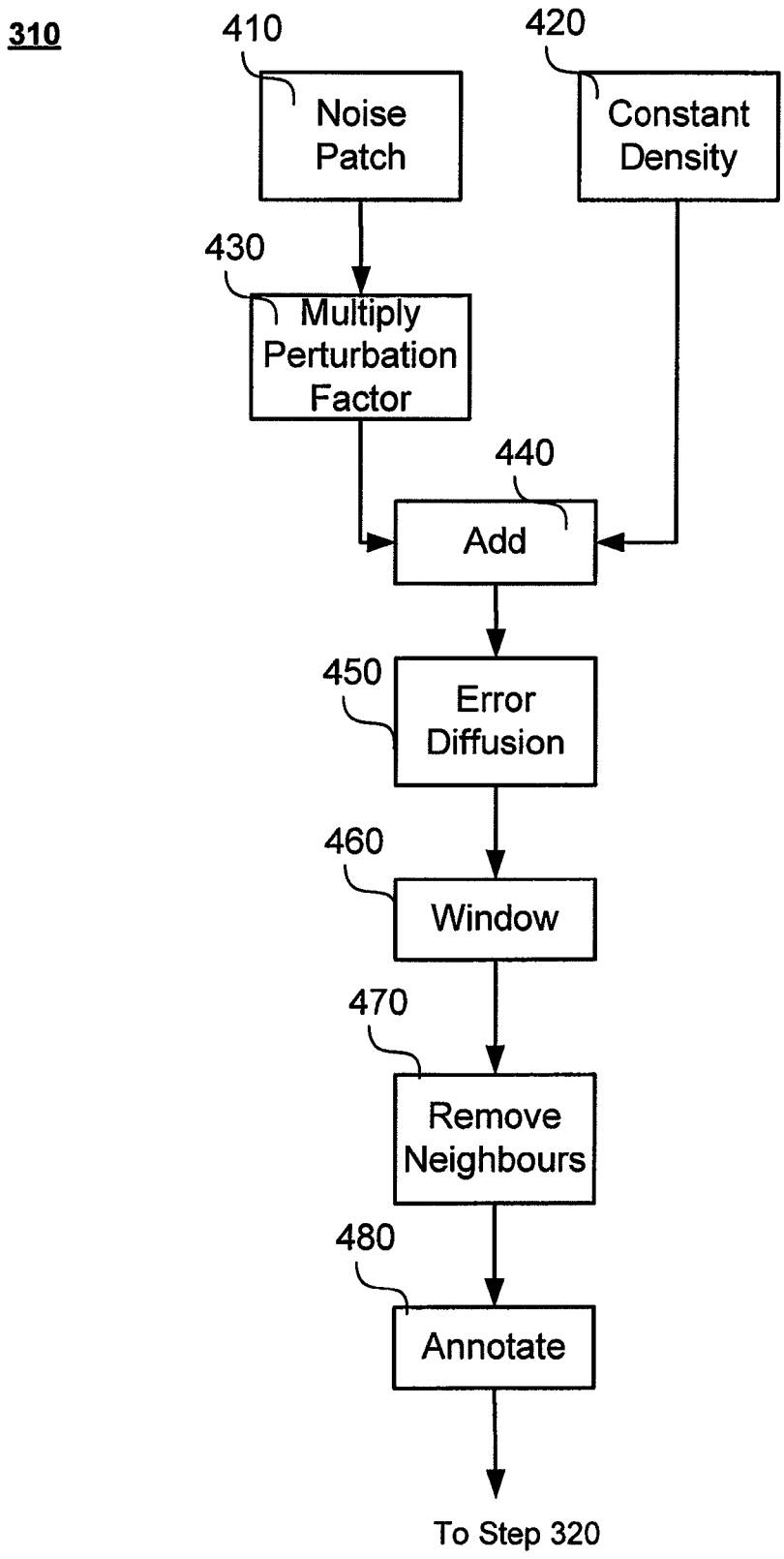
FIG. 4 is a schematic flow diagram of the generation of a patch layout.
Figure 5:
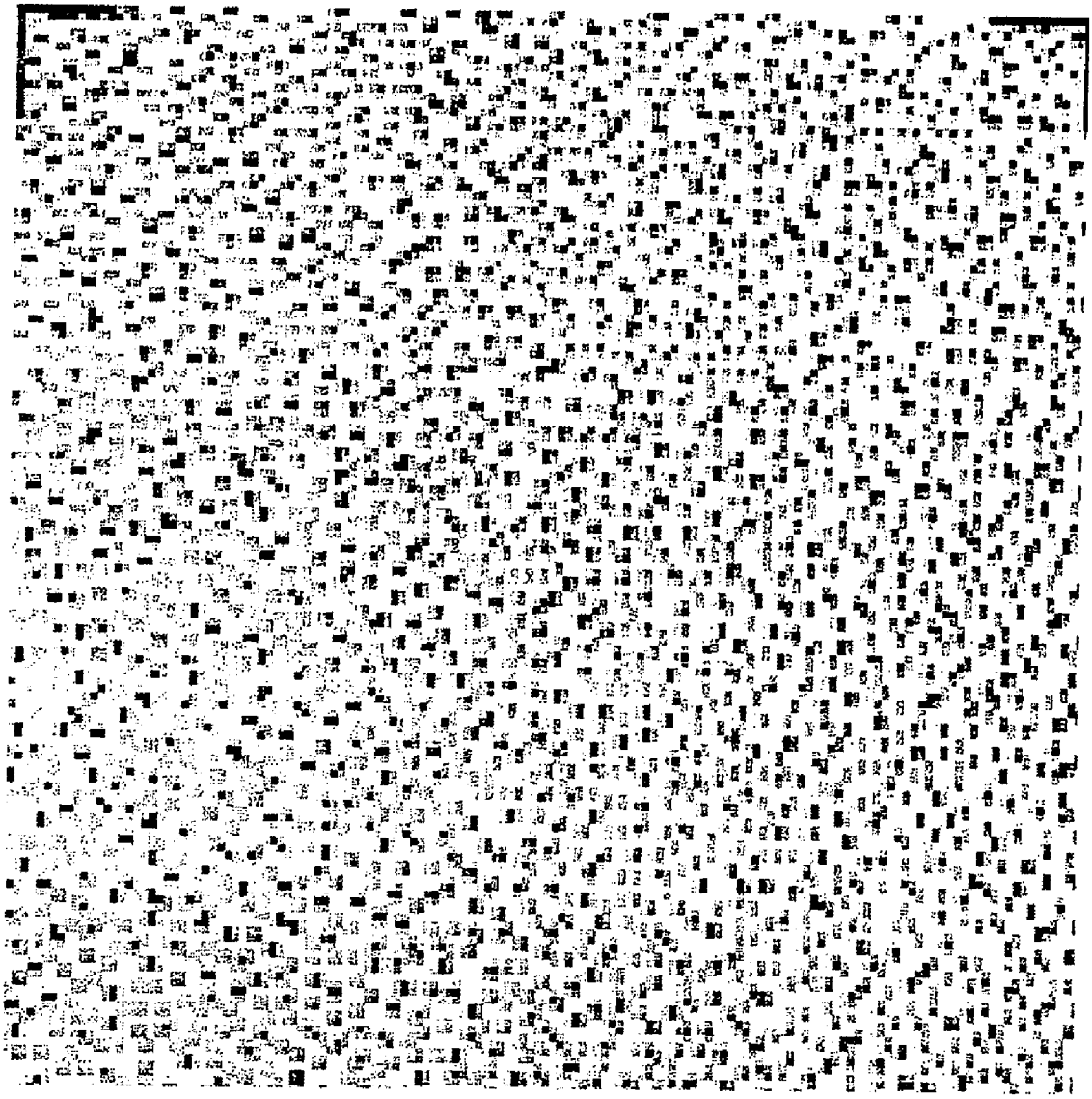
FIG. 5 shows an example printed patch.

FIG. 4 shows a schematic flow diagram of step 310 where the patch layout is generated. An example of a patch of size 144×144 pixels as generated by step 310 is shown in FIG. 5.

Step 310 starts in sub-step 410 where a uniformly distributed pseudo-random noise patch with values between −1.0 and 1.0 is created. The uniformly distributed pseudo-random noise patch is larger than the required size of the patch. For the example patch of size 144×144 pixels, the uniformly distributed pseudo-random noise patch is preferably of size 200×200 pixels.

A further patch is formed in sub-step 420, with the further patch having the same size as the uniformly distributed pseudo-random noise patch. The further patch contains a constant density representing the desired density of the patch to be printed, for example 0.15 for approximately 15% density.

In sub-step 430 the uniformly distributed pseudo-random noise patch formed in sub-step 410 is multiplied by a perturbation factor, for example 0.2, which governs the perturbation of the generated patch layout to prevent periodic patterns appearing.

In sub-step 440 the patches formed by sub-steps 420 and 430 respectively are added together to create a perturbed patch with average density close to the desired 15%.

An error diffusion algorithm is then in sub-step 450 used to quantize the real values in the perturbation patch from sub-step 440 to binary values of 0 or 1, with 0 representing inked pixels and 1 representing empty pixels.

In order to avoid regions in the error diffused patch formed by sub-step 450 which are of the wrong density, in sub-step 460 the error diffused patch is windowed to a size of 144×144.

Sub-step 470 follows where the windowed patch from sub-step 460 is processed to removed inked pixels which are not compatible with the printing mechanism of the printer, for example neighbouring pixels. Step 310 ends in sub-step 480 where annotation marks are added to the patch from sub-step 470 to assist with human or machine interpretation of the patch layout when printed. For example, excess inked pixels may be placed in the top row of the generated patch layout.

Having described step 310 where the patch layout is generated, step 320 where the chart is printed is now described in more detail.

Figure 6:
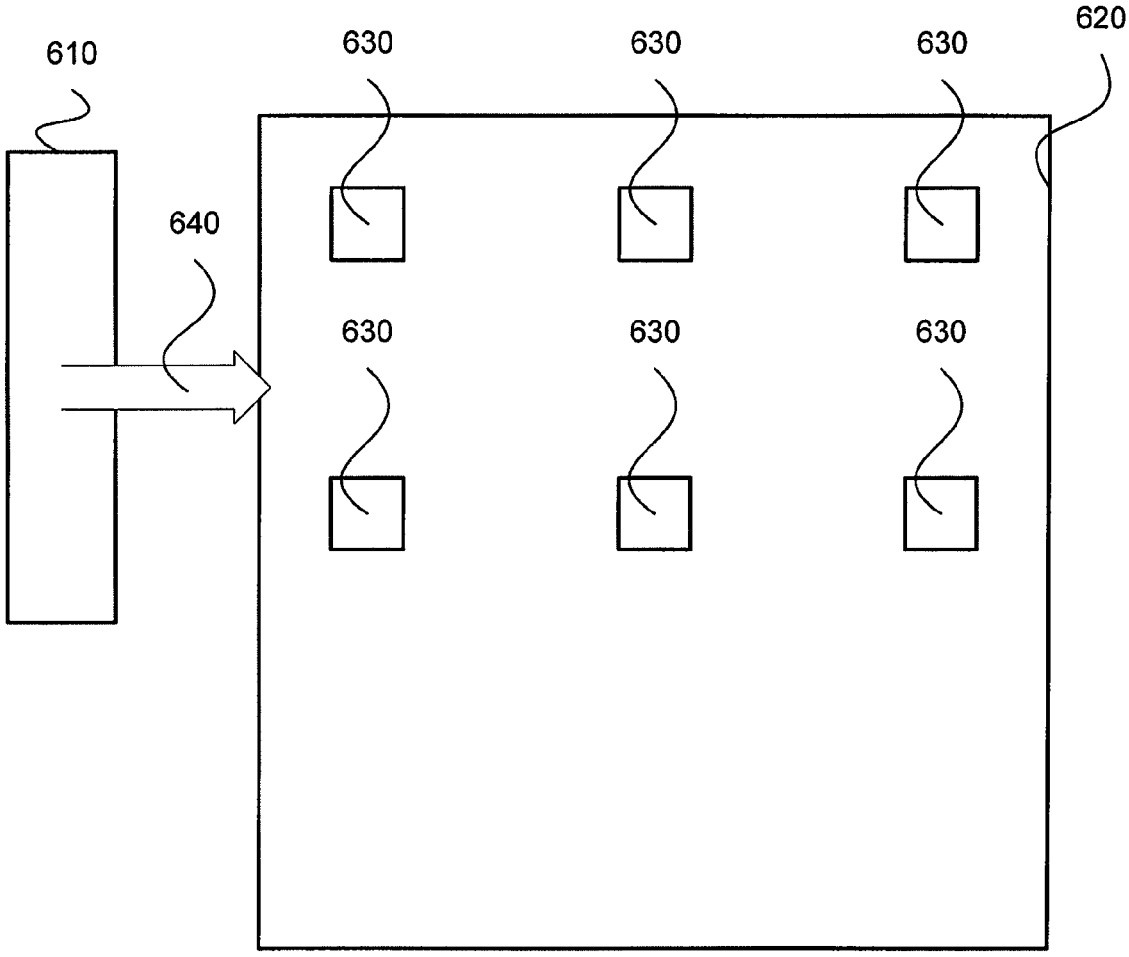
FIGS. 6 and 7 shows the printing process of a chart which may be used to measure characteristics of the printing medium feed mechanism of the ink jet printer.
Figure 7:
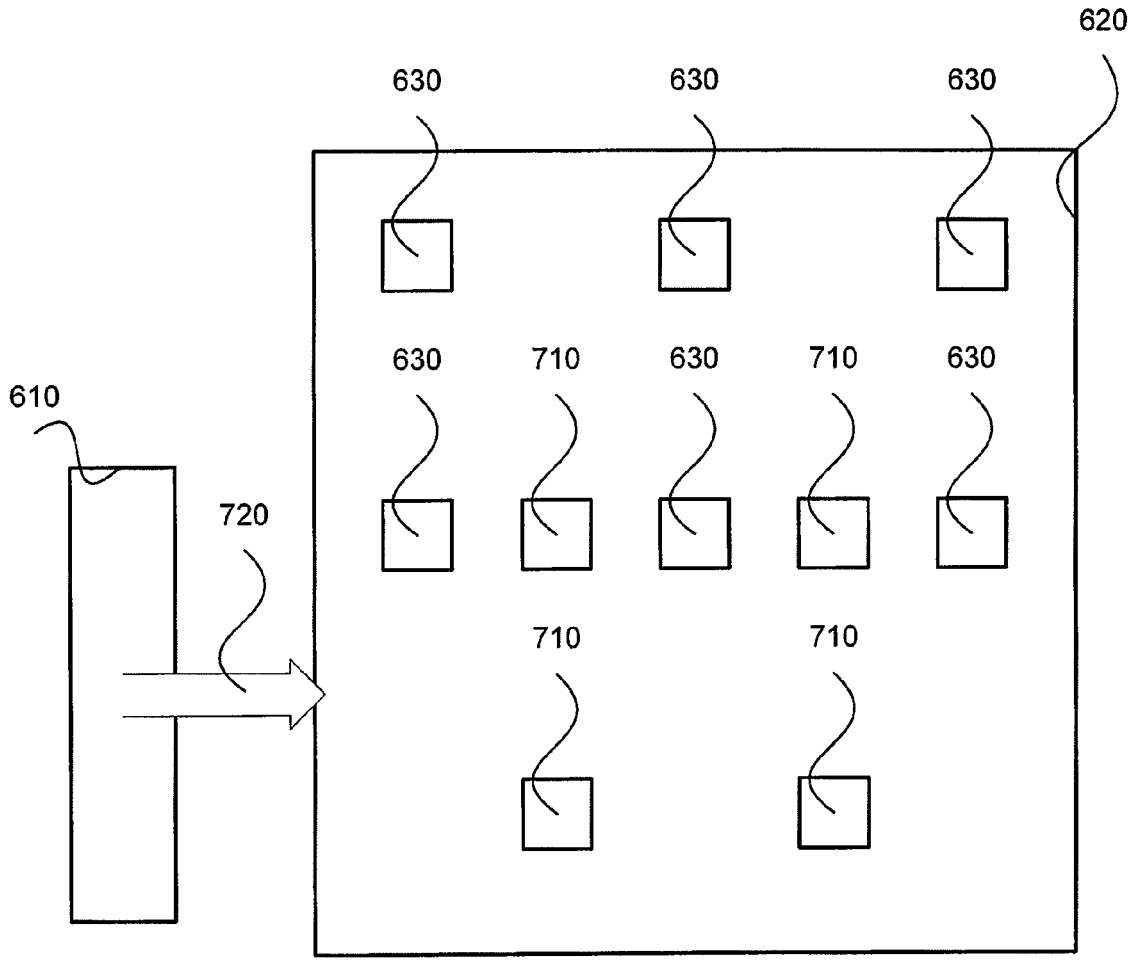

FIGS. 6 and 7 illustrate the printing process for a chart which may be used to measure characteristics of the printing medium feed mechanism of the ink jet printer 15. Referring first to FIG. 6, the print head 610 makes a forward passage 640 across the printing medium 620, which is in a first position, and records (prints) a number of patches 630, with the patches being according to the patch layout generated in step 310. As illustrated in FIG. 7, the printing medium feed mechanism then moves the printing medium 620 to a second position, and a second forward passage 720 of the print head 610 records further patches 710.

The displacement in the print medium feed direction between patches 630 and 710 printed on consecutive passages 640 and 720 of the print head 610 connotes the distance the feed mechanism transported the print medium 620. Multiple patches 630 and 710 are recorded in the print head scan direction in order to make multiple measurements or to characterise the mechanism across the print medium 620. Patches may be printed using different nozzles 220 within the nozzle groups 210 such that after the print medium 620 is fed some of the patches 630 and 710 are approximately aligned or otherwise laid out for optimal chart density and/or analysis accuracy. Multiple patches 630 and 710 may also be recorded in the print medium feed direction to provide optimal layout for measuring the previous movement of the print medium feed mechanism and the following movement.

Figure 8:
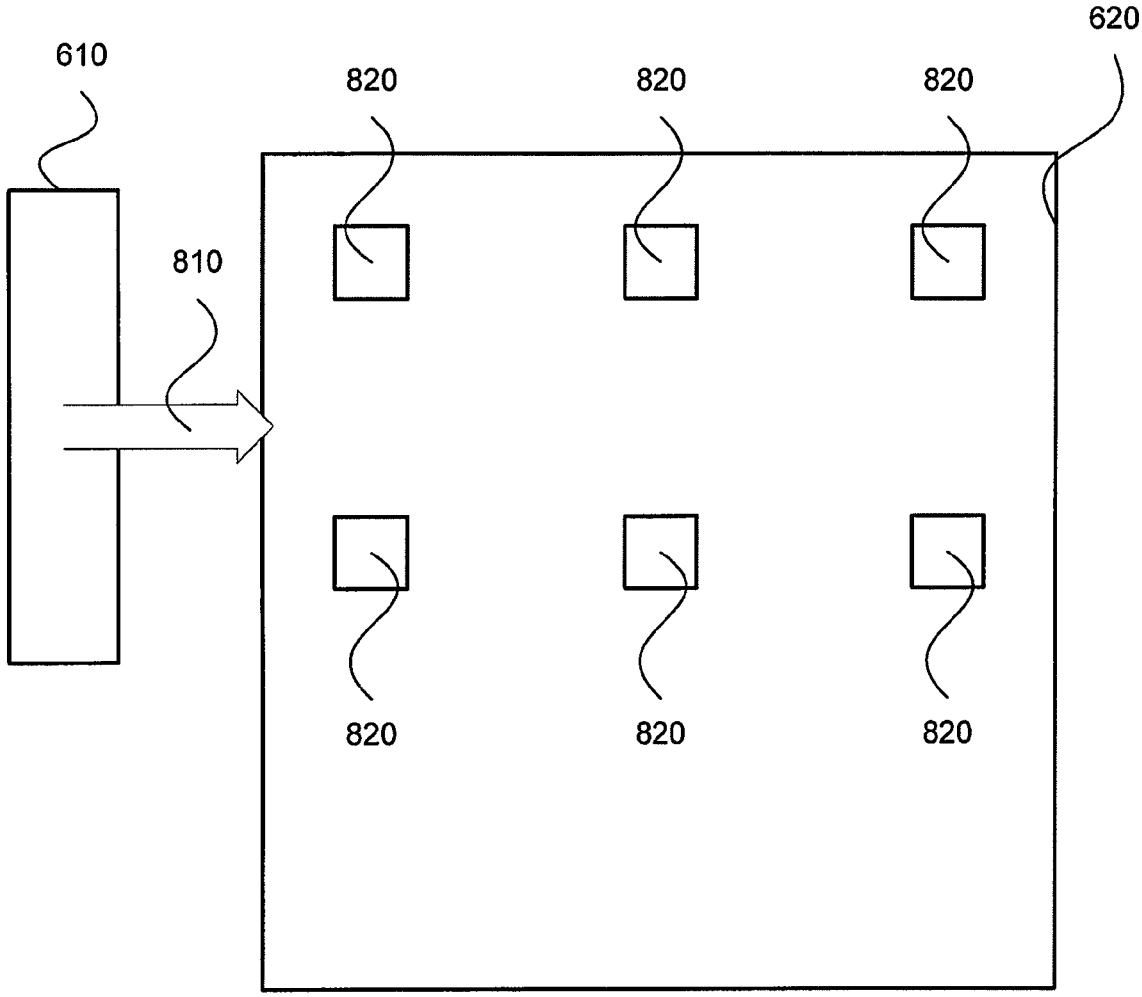
FIGS. 8 and 9 shows the printing process of a chart which may be used to measure alignment of a group of nozzles between the forward passage and the back passage of the print head of the ink jet printer.
Figure 9:
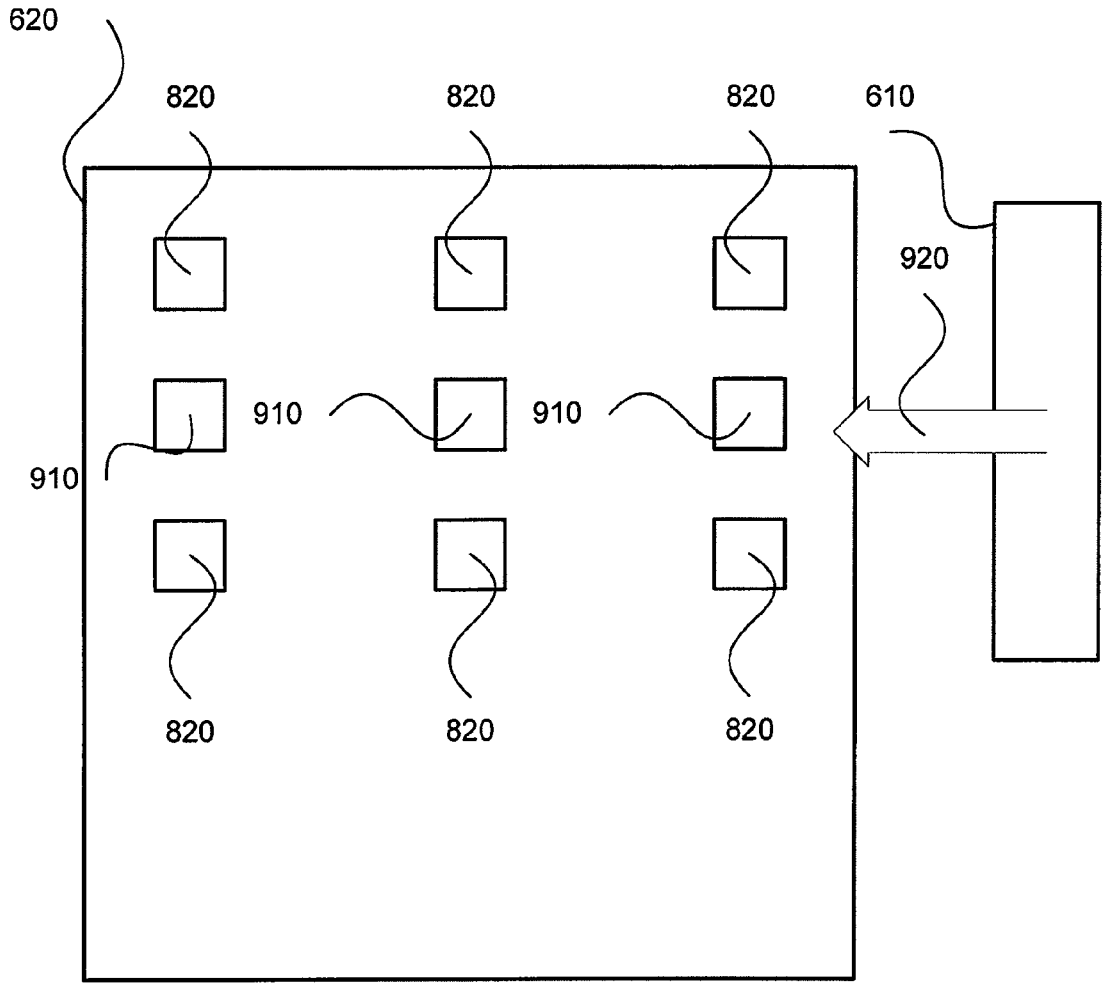

FIGS. 8 and 9 illustrate the printing process for a chart which may be used to measure alignment of a group of nozzles between the forward passage and the back passage of the print head 610 of the ink jet printer 15. Referring first to FIG. 8, the print head 610 makes a forward passage 810 across the printing medium 620 and records a number of patches 820 defined in step 310. Then, as illustrated in FIG. 9, the print head 610 makes a back passage 920 across the printing medium 620 and records further patches 910.

Patches 820 and 910 are printed with different nozzle groups or different sets of nozzles. When measuring alignment of a group of nozzles between the forward passage 810 and the back passage 920 of the print head 610, the displacement in the print head scan direction between patches 820 and 910 printed on consecutive passages 810 and 920 respectively of the print head 610 connotes the mis-alignment of the given nozzle groups between the forward and back passages 810 and 920 of the print head 610.

Figure 10:
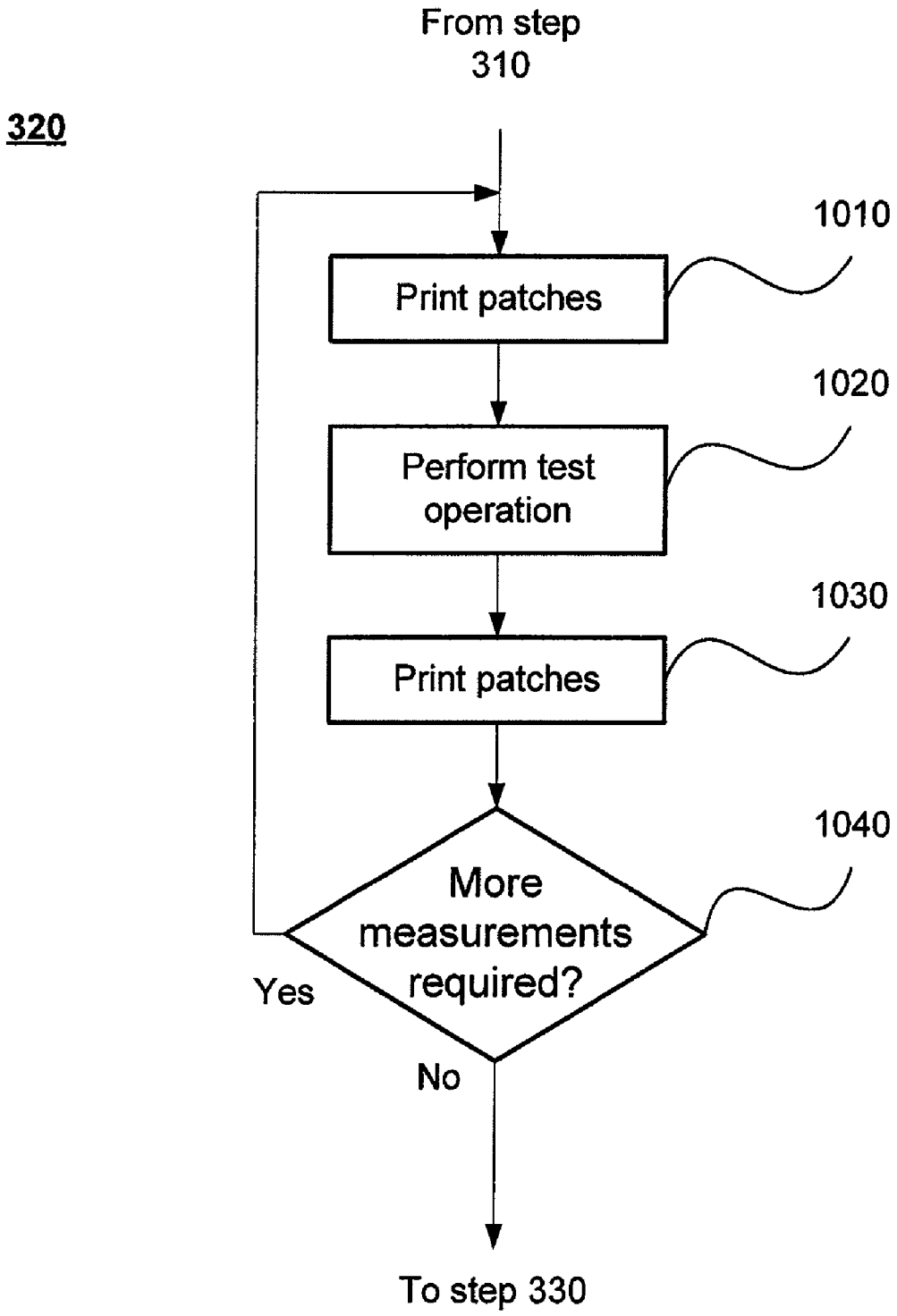
FIG. 10 is a schematic flow diagram of the printing process for the chart used to measure characteristics of the printing medium feed mechanism of the ink jet printer.

FIG. 10 is a schematic flow diagram of step 320 where the chart is printed on the printing medium 115 using the ink jet printer 15. During a pass of the print head a number of patches are recorded on the printing medium 115 in sub-step 1010. Patches may be printed from multiple nozzle groups and multiple patches may be printed in both the print medium feed direction and print head scan direction to provide optimal chart density and/or analysis accuracy.

A test operation is then performed in sub-step 1020. In the example case illustrated in FIGS. 6 and 7 where characteristics of the printing medium feed mechanism are to be measured, the print medium is fed using the printing medium feed mechanism. In the example case illustrated in FIGS. 8 and 9 where alignment of a group of nozzles between the forward passage and the back passage of the print head is to be measured, the print head scan direction is changed.

During a subsequent passage of the print head further patches are recorded in sub-step 1030 such that the displacement between the first and second set of patches connotes the printer characteristics that is to be measured.

Sub-step 1040 then determines whether more characteristics are to be measured. If so, then sub-steps 1010 to 1030 are repeated such that a further 2 sets of patches are printed, with the second set of patches being printed in sub-step 1030 after performance of a test operation in sub-step 1020. If it is determined in sub-step 1040 that no more measurements are required, then step 320 ends.

Referring again to FIG. 3, after the patches are printed on the printing medium in step 320 to form the chart, the scanner 16 is used to image the printed chart in step 330, thereby creating a digital chart image to be used by the analysis process of step 340. The scanner 16 captures information on the brightness of the chart in two dimensions. The scanner 16 may capture the chart image in one or more colour planes depending on the patch layout definition and printing process. Instead of scanner 16, an alternate imaging device may used, such as a digital camera, or an optical sensor mounted within the printer.

Additional operations may be performed on the chart image to remove or reduce artefacts and imperfections in the imaging process of step 330. Low pass filtering and down sampling of the chart image are such operations that are beneficial in reducing the effects of spatial aliasing in the imaging process.

Figure 11:
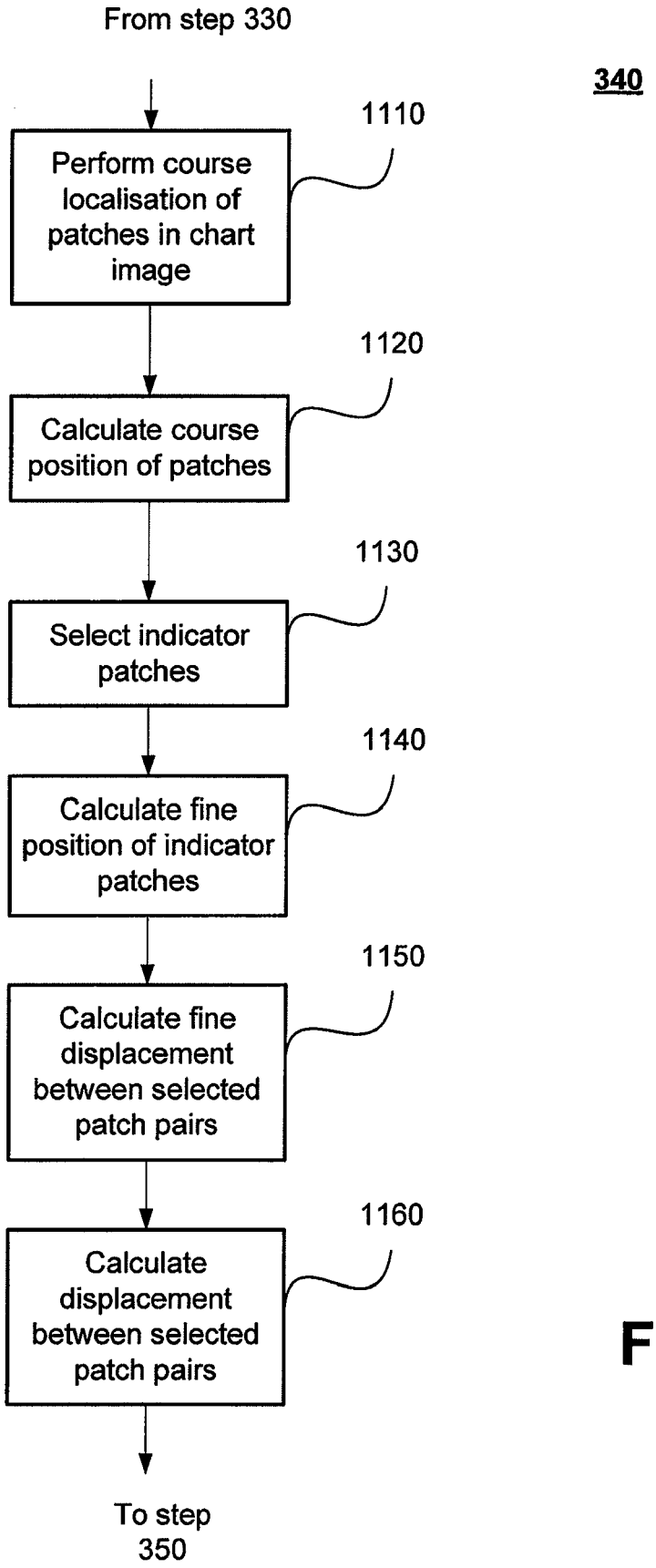
FIG. 11 is a schematic flow diagram of the analysis process.

Step 340 where the digital chart image is analysed in order to locate and determine the displacement between patches in the digital chart image is now described in more detail with reference to FIG. 11 where a schematic flow diagram of step 340 is shown. More particularly, the displacement determined is the displacement between the patches printed in sub-steps 1010 and 1030 respectively.

Multi-colour charts may have each colour channel analysed independently and their results combined in a statistical fashion to improve the overall accuracy of the measurements. Alternatively, in the case of two-colour charts, the colour channels may be represented by the real and imaginary part of a complex value and the resultant complex image analysed in step 340, thereby achieving improved accuracy.

Figure 12:
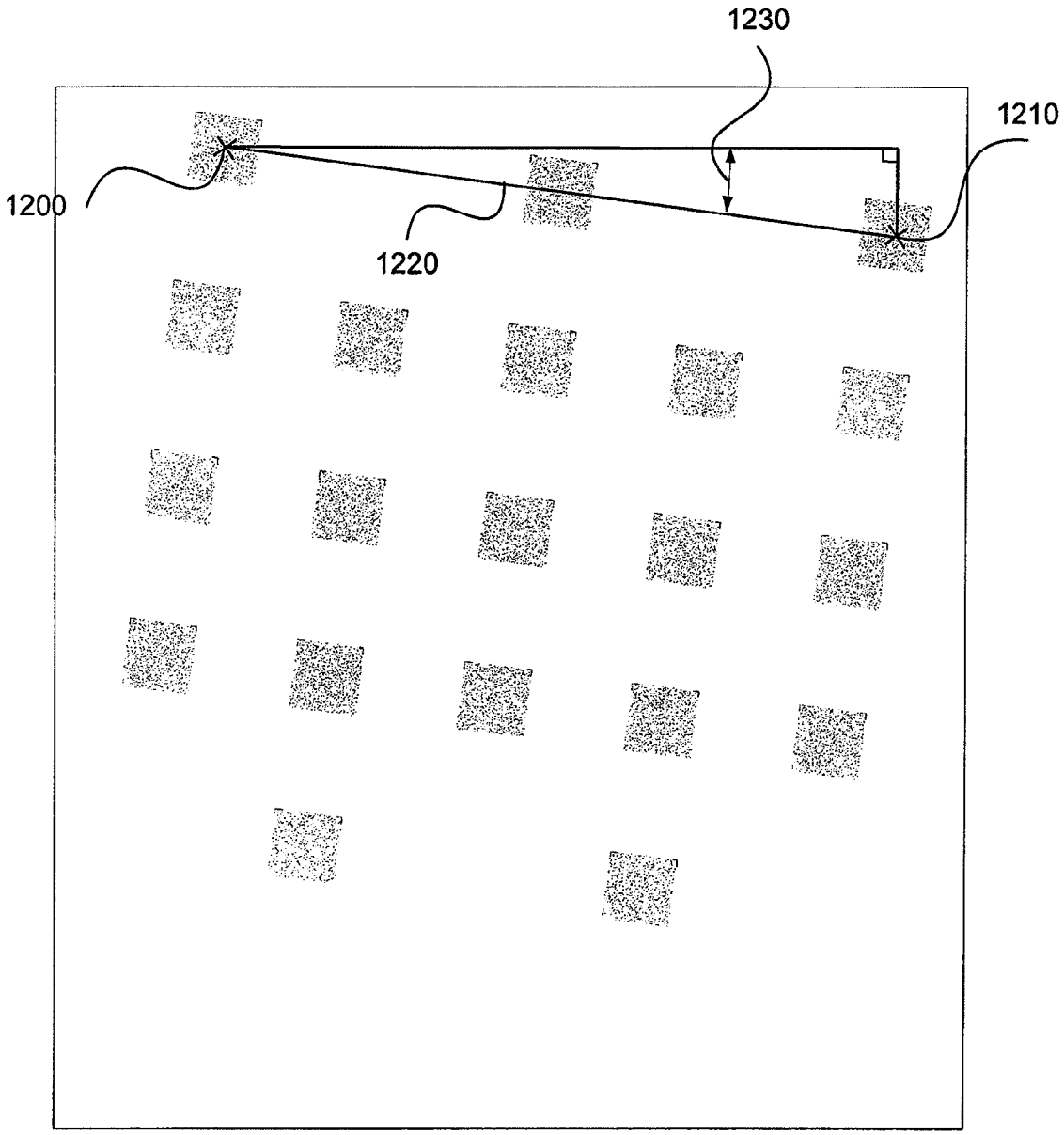
FIG. 12 illustrates the angle and scale values obtained during course localisation of the patches in a chart image.

Step 340 starts in sub-step 1110 where the chart image is analysed to determine an approximate orientation and scaling of the chart image with respect to the printed chart, with the orientation and scaling being an aid to locating the patches in the chart image. Several different methods may be used in sub-step 1110 to determine the orientation and scaling. For example, in the method illustrated in FIG. 12, the patches 1200 and 1210 in the top left and top right corners respectively are located by searching for dark or coloured corners in the chart image. The positions of patches 1200 and 1210 are then used to determine a base position, a scale factor 1220 and chart image angle 1230.

Fiducial marks printed on the chart may likewise be used to determine an approximate affine transform to relate the patches in the printed chart with those in the chart image.

Correlation of the chart image with the patch generated in step 310 may also be used to locate patches in the chart image by searching for correlation peaks in the correlation image.

Figure 13:
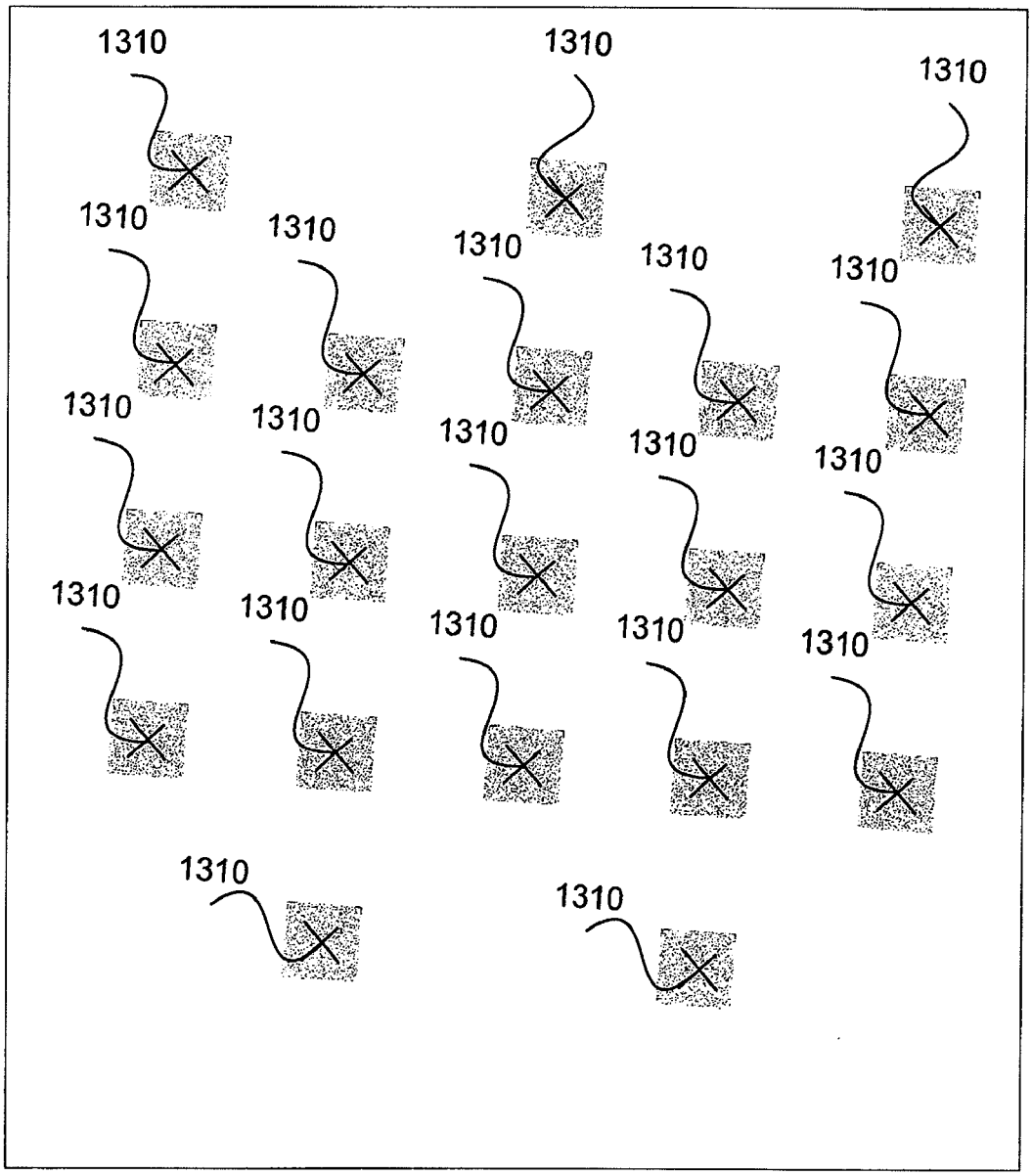
FIG. 13 shows the course position obtained for each patch in the chart image.

Once the approximate orientation and scaling of the chart image with respect to the printed chart has been determined in sub-step 1110, in sub-step 1120 a coarse position for each patch, as indicated by positions 1310 in FIG. 13, is directly calculated.

Figure 14:
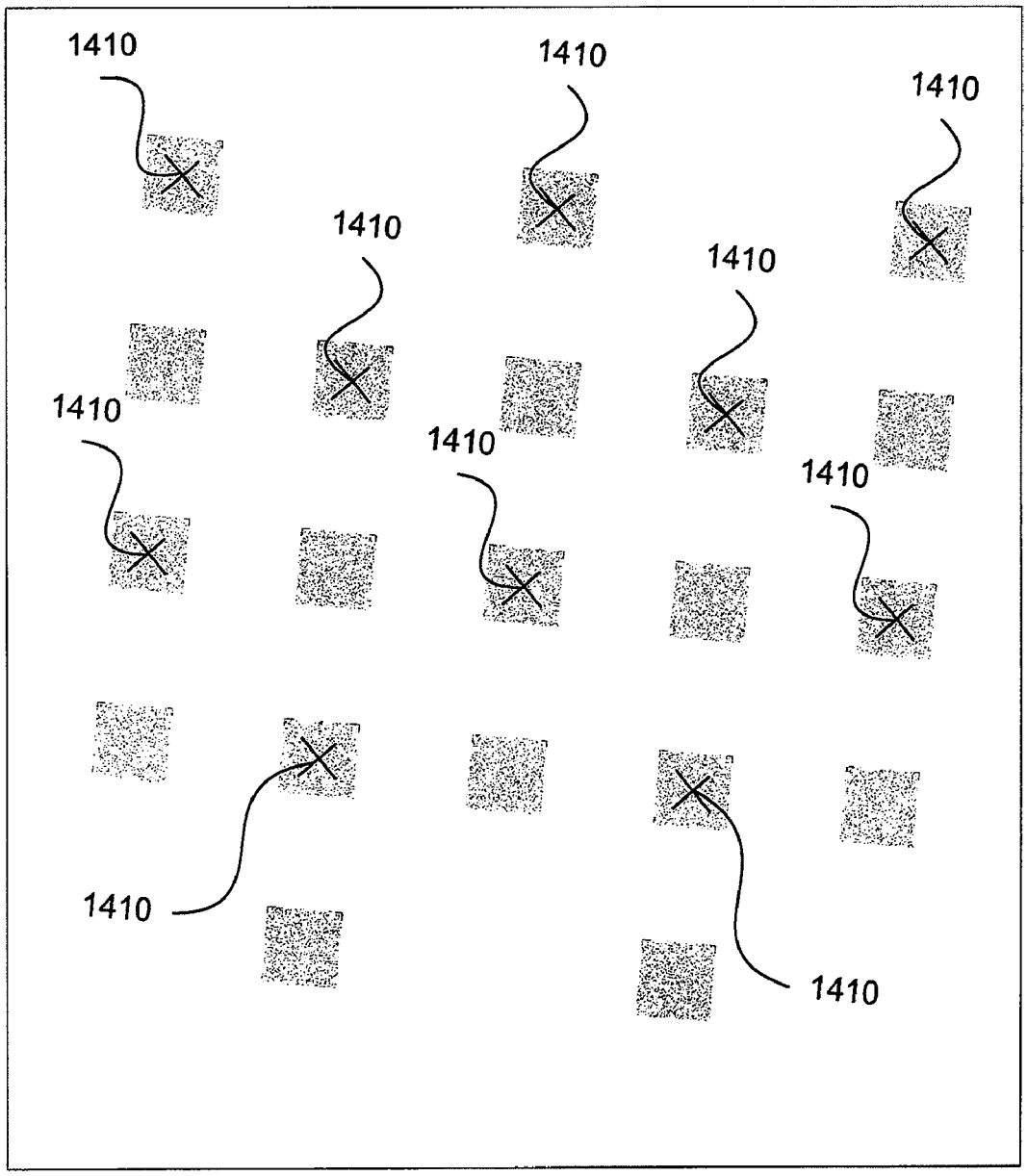
FIG. 14 shows the location of the indicator patches on the chart image.
Figure 15:
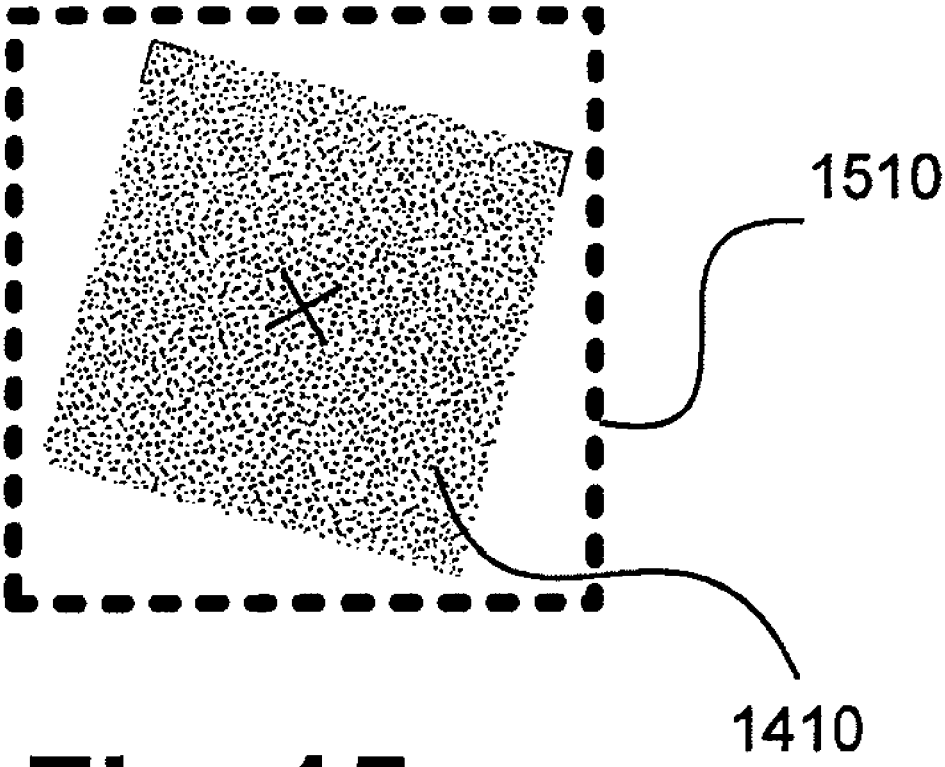
FIG. 15 shows the extraction a patch from the chart image.

A selection of patches in the chart image is made, and extracted, in sub-step 1130. The selected patches are to be used for an affine fit of the chart image, and are referred to as indicator patches. The indicator patches 1410 are shown in FIG. 14. As is illustrated in FIG. 15, each indicator patch 1410 is extracted from the chart image, with a sufficient boundary 1510 around each indicator patch 1410 to ensure that the full patch 1410 appears in each extract, despite the approximate nature of their location.

In sub-step 1140 an accurate position for each indicator patch 1410 is obtained by correlation of each indicator patch 1410 and a replica patch, using methods to be discussed later.

The accurate locations determined for the indicator patches 1410 are used as a basis for extracting patches neighbouring the indicator patches 1410, and also for calculating an accurate affine fit for the chart image, giving gross rotation and scale information about the printing and scanning process.

Using the derived locations of all relevant patches in the chart image, pairs of patches are extracted in 1160 and accurate distances measurements calculated between each pair.

Figure 16:
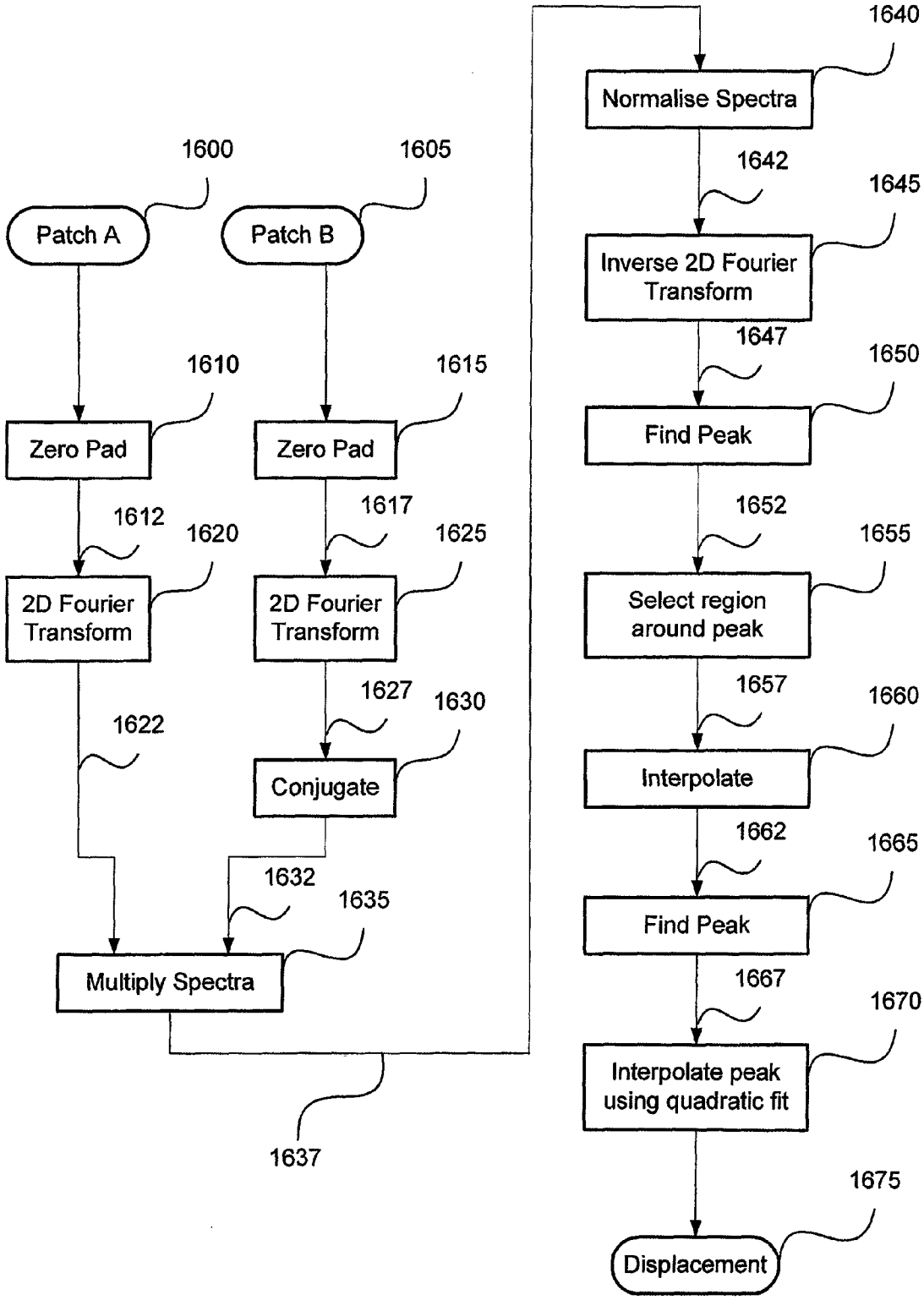
FIG. 16 is a schematic flow diagram showing the steps in correlation used to determine the displacement between two patch images.

FIG. 16 shows the steps involved in the correlation process used to analyse in step 340 the digital chart image in order to locate and determine the displacement between patches in the digital chart image. This process operates on two equal sized patch images 1600 and 1605, and calculates a high resolution displacement 1675 between the features within the two patch images 1600 and 1605. More particularly, the displacement 1675 is a vector offset from patch 1600 to patch 1605. The process relies on the two patch images 1600 and 1605 containing similar image data that may be at different spatial positions within their respective image regions.

At least one of the patch images 1600 and 1605 is obtained from the chart image. The other patch image 1600 or 1605 may be either obtained from the chart image or formed digitally in step 310. The former case where both patch images 1600 and 1605 are obtained from the chart image is used to calculate the distance, in pixels, between two patches. The later case where one patch image 1600 or 1605 is formed digitally is used to calculate the absolute position of the patch in the chart image, in pixels. In both cases the displacement 1675 is estimated to sub-pixel accuracy in both dimensions.

The correlation process starts in step 1610 where patch 1600 is padded with zeroes in one or both dimensions to produce a padded patch image 1612. Zero padding reduces aliasing artefacts in the subsequent processing stages.

The padding size is typically the same size as the patch image. The padding size may also be chosen such that the resultant padded image region is a size suitable for a computationally efficient implementation of the subsequent 2D Fourier transform.

Patch image 1605 is also padded with zeroes in step 1615 to produce a padded patch image 1617. The padding size is the same size as that used on patch image 1600 in step 1610.

The padding steps 1610 and 1615 are optional and may be omitted with only a minor loss of accuracy if both patch images 1600 and 1605 are similarly aligned within their respective image regions.

The padding steps 1610 and 1615 may also optionally involve the application of an amplitude weighting function to the edges of the patch images 1600 and 1605. The weighting function is chosen to minimise artefacts caused by the boundary between the patch image region and padding region.

Next, in steps 1620 and 1625, a 2-Dimensional Fourier Transform is applied to the padded patch images 1612 and 1617 respectively to form spectra 1622 and 1627. Both spectra 1622 and 1627 are two dimensional, complex valued arrays.

A conjugated spectrum 1632 is formed in step 1630 from spectrum 1627 by negating the imaginary part of spectrum 1627.

The two complex spectra 1622 and 1632 are then combined by multiplying the arrays on an element by element basis in step 1635 to form correlation spectrum 1637. The correlation spectrum 1637 is further processed in step 1640 where the amplitudes of the complex valued correlation spectrum 1637 are unitised to form a normalised correlation spectrum 1642. Step 1640 also involves the suppression of the high frequency spectral components by the application of a spectral amplitude weighting function.

A 2-Dimensional Inverse Fourier Transform is then in step 1645 applied to the normalised correlation spectrum 1642 to form a correlation amplitude image 1647.

The largest absolute amplitude value in the correlation amplitude image 1647 is next found in step 1650. The offset from the image centre of this largest amplitude value gives a coarse peak position 1652, measured in whole image pixels.

An image region, known as the peak region image 1657, is selected in step 1655 from the correlation amplitude image 1647 in the vicinity of the coarse peak position 1652. This peak image region 1657 is smaller than the correlation amplitude image 1647 so as to reduce the computational requirements of the subsequent processing stages.

The peak region image 1657 is interpolated in step 1660 in both dimensions by an integer factor using up-sampling and linear filtering. The position of the amplitude peak in the resultant interpolated peak region image 1662 is then determined in step 1665. The interpolation allows the position of the peak to be determined with sub-pixel resolution.

Further improvement to the accuracy of the peak position determination is performed in step 1670 by interpolation using quadratic polynomials. The peak is interpolated independently in each of the image dimensions. The quadratic interpolation is performed by fitting a quadratic polynomial to the image elements in the immediate vicinity of the peak, using least squares error criteria. The quadratic is then solved analytically to obtain the position of the peak. The resultant displacement 1675 is obtained to an accuracy significantly greater than the resolution of the original patch images 1600 and 1605, and the interpolated correlation image.

Figure 17:
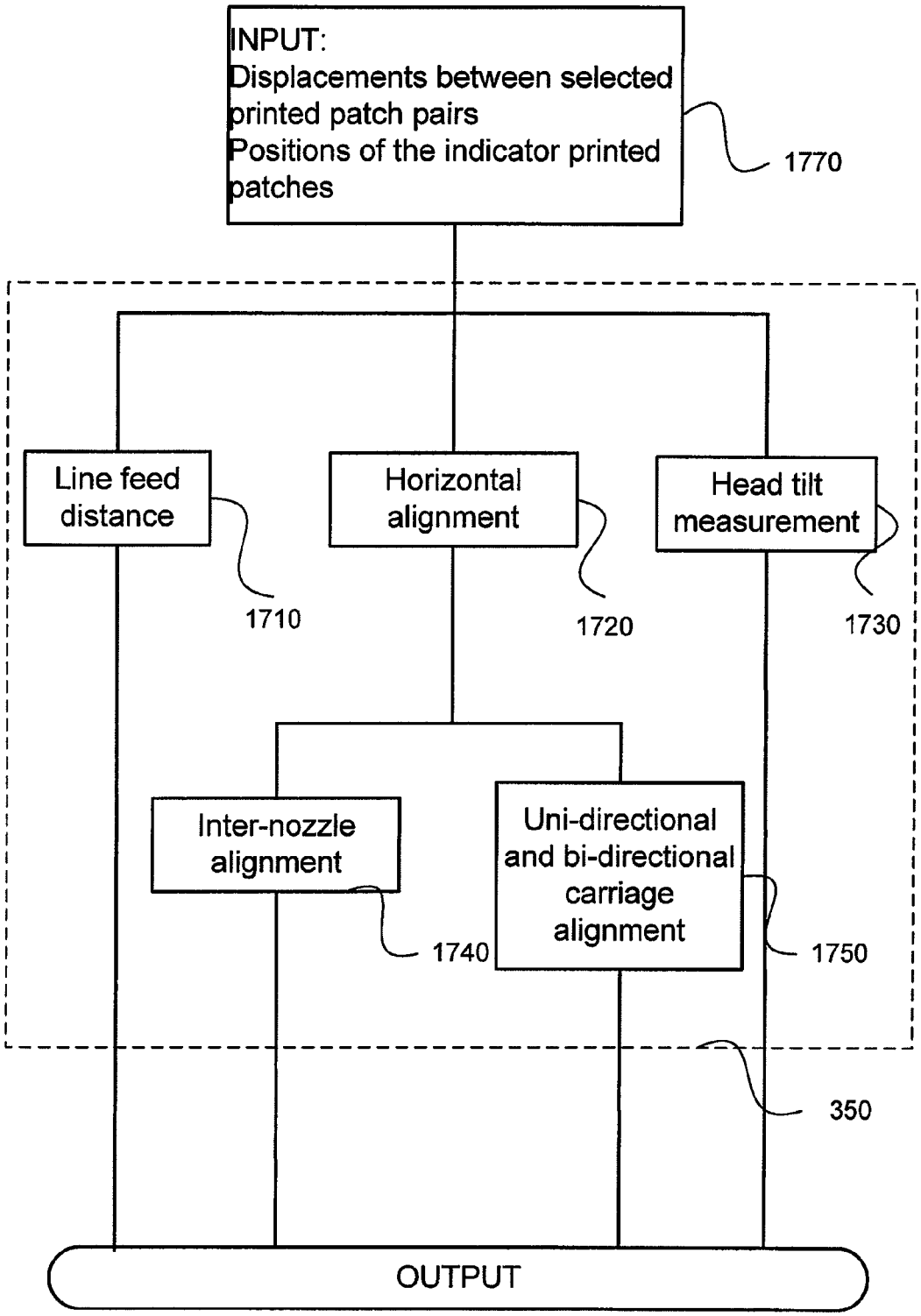
FIG. 17 illustrates the categorisations of printer characteristics.

The method 300 is suitable for many different types of printer characteristics. As is illustrated in FIG. 17, the printer characteristics determined in step 350 may be grouped into; line feed distance 1710, horizontal alignment 1720, and head tilt measurement 1730. The horizontal alignment 1720 may further be categorized into the inter-nozzle alignment 1740 and uni-directional and bi-directional carriage alignment 1750.

It is possible to measure all the above-mentioned printer characteristics, or any subset thereof, in one chart. The chart layout, patch characteristics, choice of selected patch pairs, and choice of indicator patches determine the suitability of a chart for a particular printer characteristic or set of printer characteristics. The resultant displacements between the selected patch pairs, and the positions of the indicator patches 1770 are used in the printer characteristics determination step 350.

Figure 18:
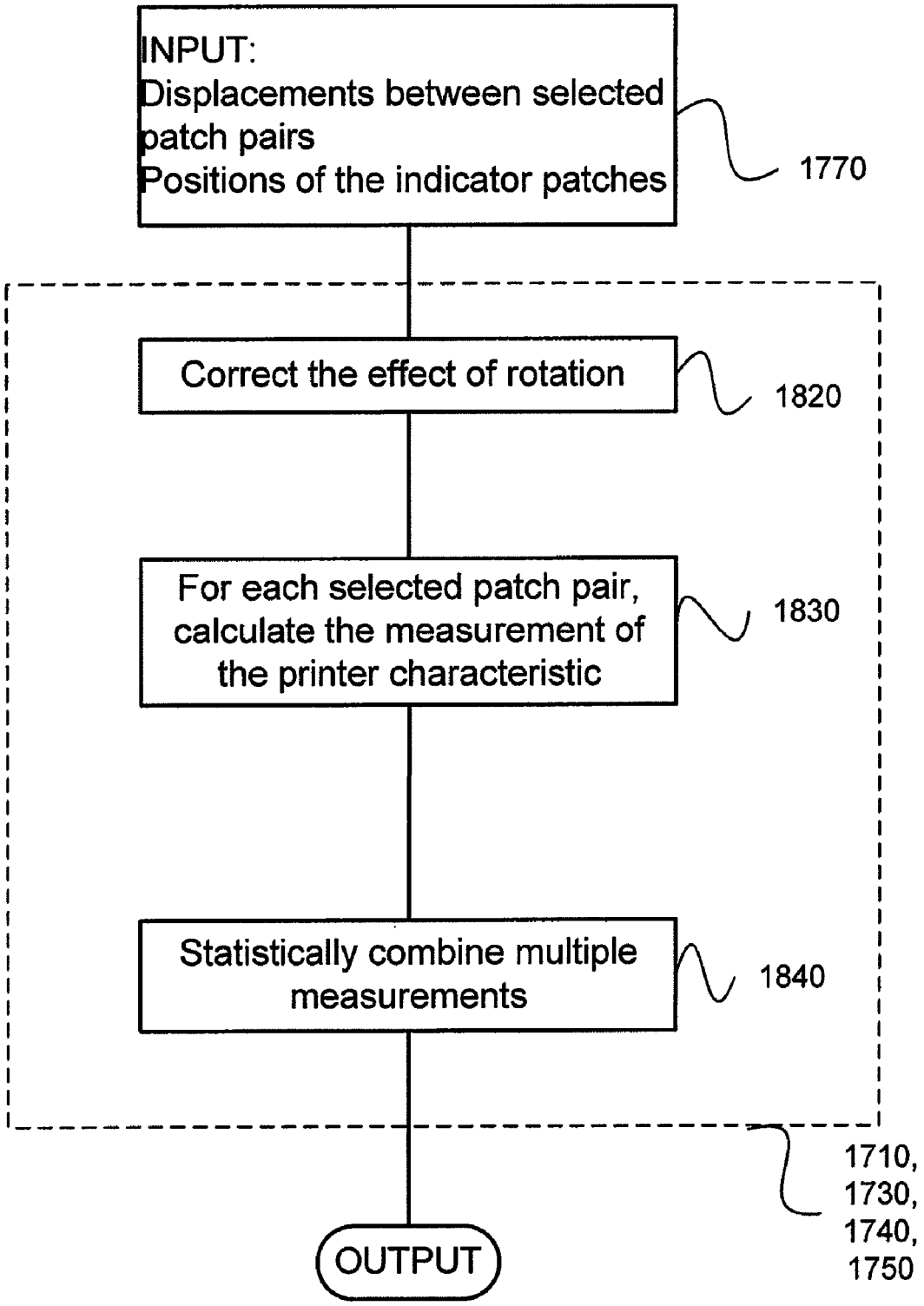
FIG. 18 illustrates the process of printer characteristic determination.

FIG. 18 shows the steps involved in determining the printer characteristics from the given inputs; displacements between the selected printed patch pairs, and the positions of the indicator printed patches 1770.

In the typical imaging scenario the printed medium is rotated relative to the axes of the scanner 16. A rotation correction sub-step 1820 may be performed to removed the effects of this rotation and align the measured inter-patch displacements and patch positions with the axes of the scanner 16. An affine transformation matrix is calculated in sub-step 1830 using the measured positions of the indicator patches 1770, and their expected positions if no image rotation were present. A linear least square technique may be used to obtain this affine transformation matrix. The effect of the rotation is then corrected by multiplying the measured displacements with the affine transformation matrix.

In the situation where multiple independent measurements of the printer characteristic are determined, these measurements are statistically combined in sub-step 1840 to provide an overall measurement. Statistical methods, such as calculating the average, or calculating the median, are used in sub-step 1840 to combine the multiple measurements, thereby reducing the measurement variance.

Figure 19:
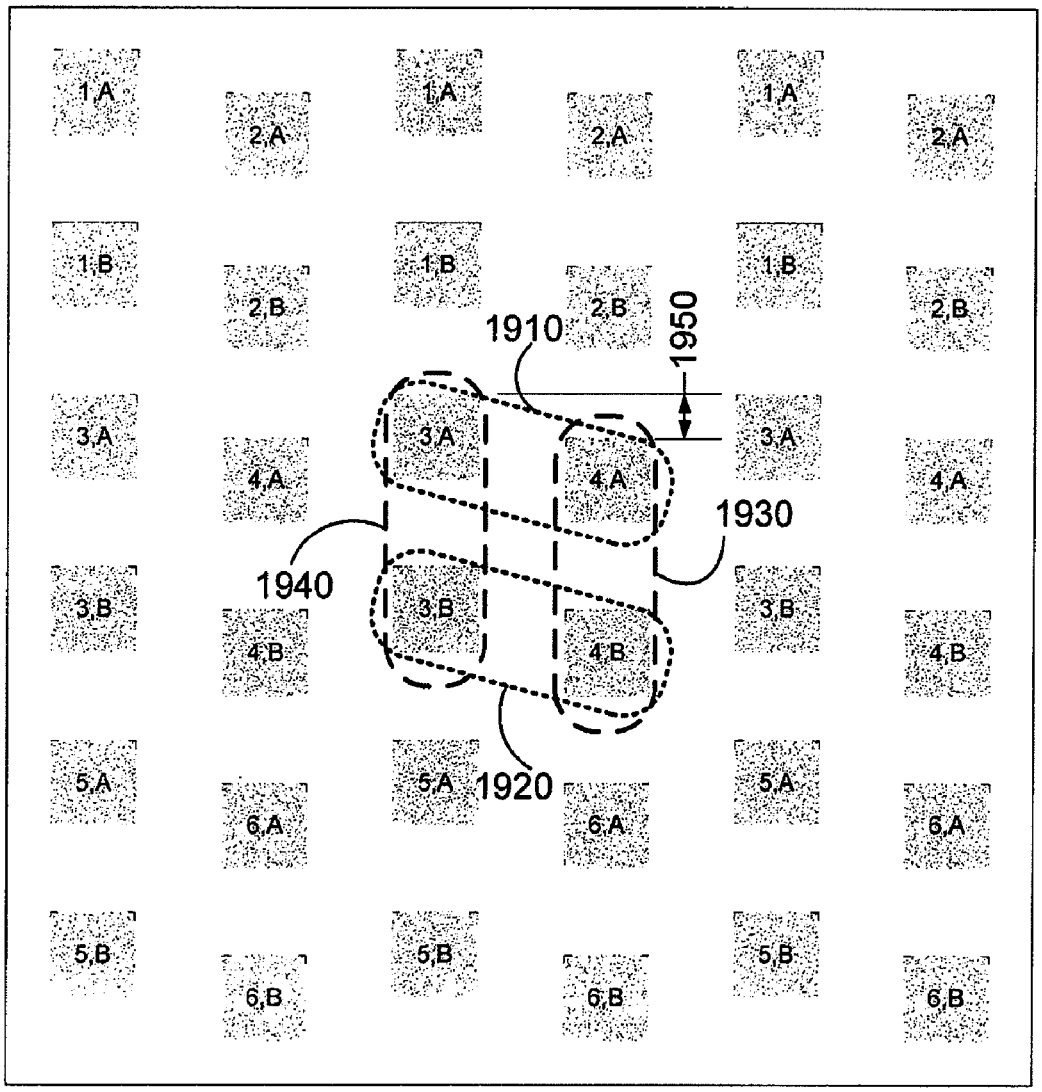
FIG. 19 illustrates an example of the printed chart used for determining line feed characteristics.

A first implementation of the determination of the printer's line feed distance characteristic is now described in detail with reference to FIG. 19 where a chart used for that purpose is shown. The printer line feed distance is a measure of how far the print medium is advanced by the line feed mechanism of the ink jet printer 15. The patches labelled 1 are printed in the first passage. The patches labelled 2 through 6 are printed by subsequent passages of the print head which are separated by advances of the print medium. The patches labelled A are printed by a first set of nozzles, whereas the patches labelled B are printed by another set of nozzles which are separated from the first set of nozzles. In this example the patches labelled A are also used as the indicator patches in the rotation correction step 1820.

The nominal resolution of the scanner 16 is known, but due to imperfections of the scanner 16, the actual resolution of the chart image will vary over the image. This deviation is referred to as image device distortion. If the image resolution has a slow variation a local image resolution exists. When determining the line feed distance it is important to make corrections for the local image resolution. This may result in significant improvements to the measurement accuracy when low quality imaging devices are employed. The known (or predetermined) distance between the nozzle sets used to print patches labelled A and B respectively is used for the purpose of measuring the local image resolution. That is the nozzle sets used to print the patches labelled A and B are a predetermined distance apart. This distance is accurately known from the geometry of the print head.

In one preferred implementation, four patch pair displacements are used for each printer line feed distance measurement. More particularly, as is indicated in FIG. 19, the displacement between printed patch pairs 1910, 1920, 1930 and 1940 in the medium feed direction are used. The displacements in the medium feed direction between printed patch pairs 1930 and 1940 represent the distance between the nozzle sets used to print patches labelled A and B, and are used to correct for the local image resolution by providing a local scaling factor. The local scaling factor may be represented as a ratio between one of the patch pairs (e.g., 1930) and the distance between the nozzle sets. The displacements in the medium feed direction between printed patch pairs 1910 and 1920 correspond to the uncorrected line feed distance measurements. The corrected line feed distance, 1950, is given by:

$$LineFeed = NSD \cdot \frac{LF1 + LF2}{H1 + H2}$$

wherein:

NSD denotes the nozzle set predetermined distance between nozzle set A and nozzle set B as determined from the print head geometry;

LF1 denotes the displacements between the selected printed patch pairs 1910 in the medium feed direction;

LF2 denotes the displacements between the selected printed patch pairs 1920 in the medium feed direction;

H1 denotes the nozzle set distances in the image between patch pair 1930; and H2 denotes the nozzle set distances in the image between patch pair 1940.

In an alternative preferred implementation of determining the printer line feed characteristic, in order to ensure that the displacement measurements, in the medium feed direction, are small, different patch placements and selection of patch pairs are used, thereby reducing the measurement sensitivity to deviations of the local image resolution from the nominal image resolution. This alternate implementation requires fewer computations than the implementation described above with reference to FIG. 19 and is generally more accurate when used with imaging devices that have significant spatial distortion. However, it is less general and cannot measure all possible desired parameters.

Figure 20:
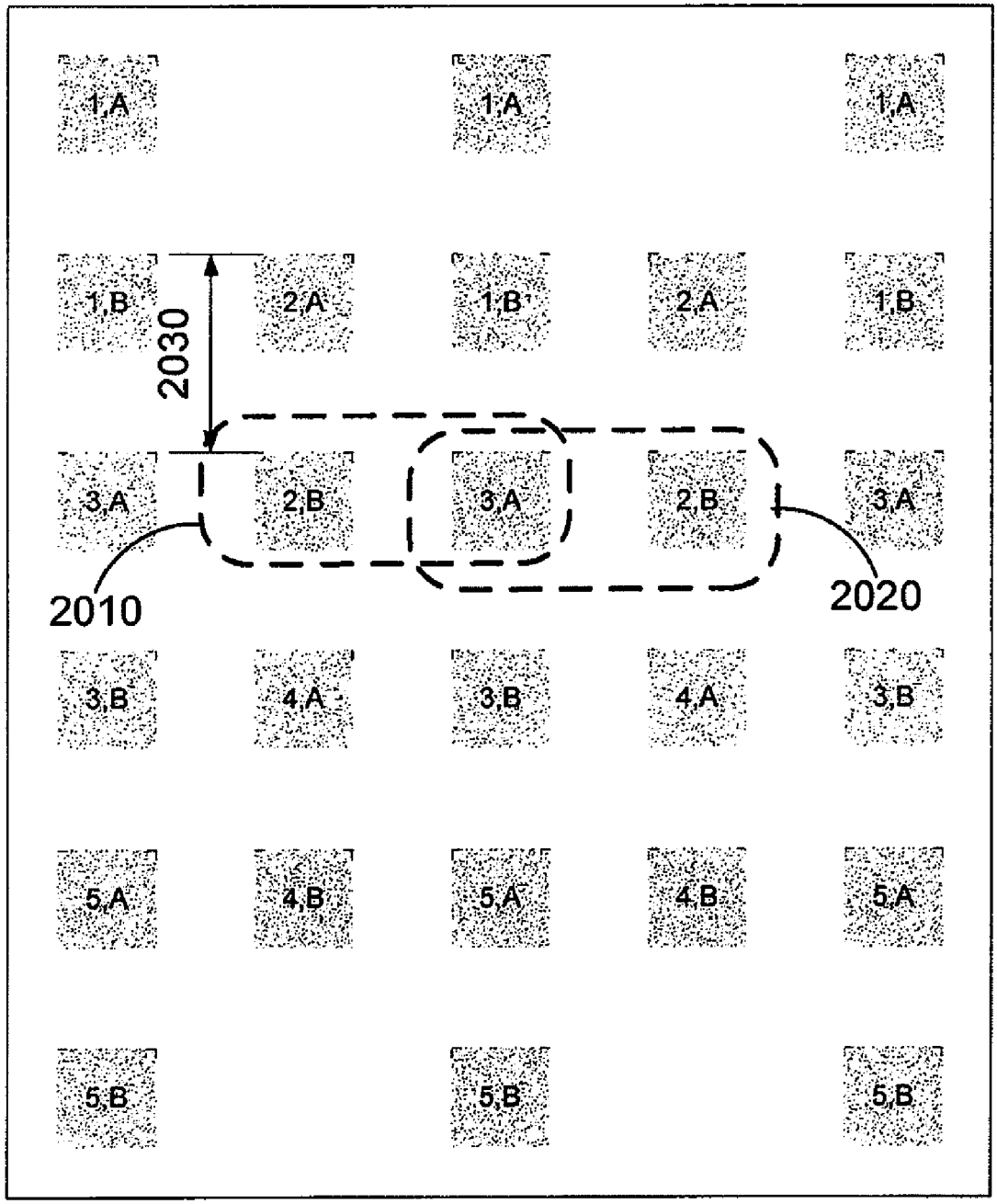
FIG. 20 illustrates an alternative example of the printed chart used for determining line feed characteristics.

FIG. 20 shows a chart used for the determination of the printer line feed distance characteristic of the ink jet printer 15 using this alternate implementation. The patches labelled 1 are printed in the first passage. The patches labelled 2 through 5 are printed by subsequent passages of the print head which are separated by advances of the print medium. The patches labelled A are printed by a first set of nozzles, whereas the patches labelled B are printed by another set of nozzles which are separated from the first set of nozzles. In this example the patches labelled A are also used as the indicator patches in the rotation correction step 1820.

In this arrangement the nozzle set distance 2030 is equal to the nominal medium feed distance that is used to print the chart such that the displacement of the patches labelled A and patches labelled B on consecutive passes are largely aligned in the medium feed direction.

The line feed distance measurement is obtained from a single displacement measurement depicted by either the displacement in the medium feed direction between printed patch pair 2010 or 2020 in this example. However, to improve accuracy and reduce sensitivity to image rotation, two measurements are combined in a symmetrical manner.

Using this alternate implementation the line feed distance is given by:

$$LineFeed = NSD + \frac{E1 + E2}{2 \cdot R}$$

wherein:

NSD denotes the nozzle set distance between nozzle set A and nozzle set B, 2030, as given by the print head geometry;

E1 denotes the displacement between the selected printed patch pairs 2010 in the medium feed direction;

E2 denotes the displacement between the selected printed patch pairs 2020 in the medium feed direction; and R denotes the nominal image resolution given by the imaging device.

The accuracy can be further improved by correcting for the local image resolution instead of using a fixed quantity, R, for the image resolution. However since the displacement measures E1 and E2 are small, the accuracy improvement is minimal and may not warrant the additional computation.

Figure 21:
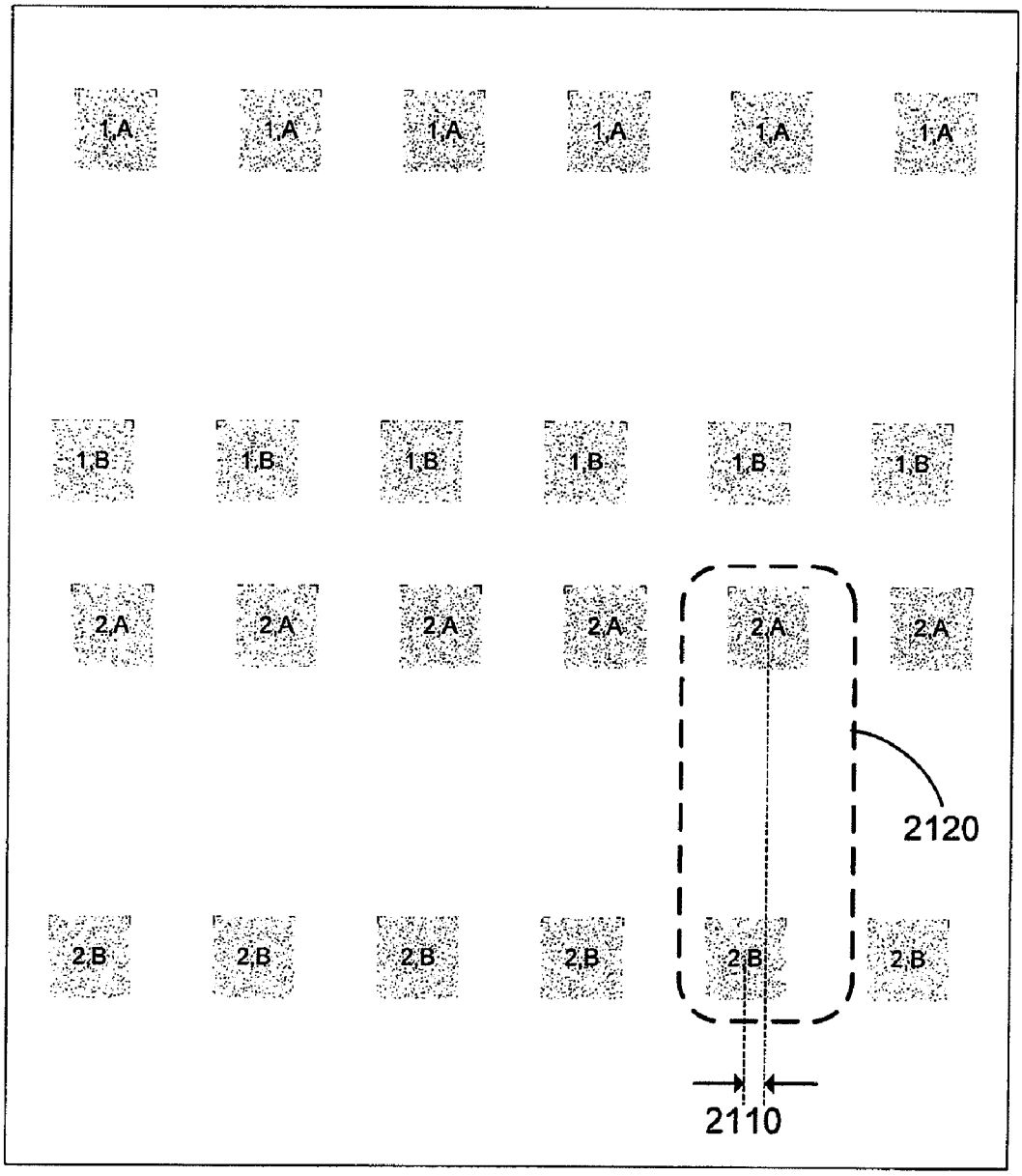
FIG. 21 illustrates an example of the printed chart used for determining head tilt characteristics.

FIG. 21 illustrates an example of the printed chart used for determining the head tilt characteristics of the ink jet printer 15. The patches labelled 1 are printed in the first passage. The patches labelled 2 are printed by the subsequent passage of the print head which is separated by an advance of the print medium. The patches labelled A are printed by a first set of nozzles, whereas patches labelled B are printed by a different set of nozzles, with both sets of nozzles belonging to the same nozzle group. In this example the patches labelled A are also used as the indicator patches in the rotation correction step 1820.

Head tilt refers to the angle between the actual direction of the nozzle groups and the designed direction of the nozzle groups, which is perpendicular to the direction of the print passage. This angle is measured from the displacement 2110 between a printed patch pair 2120 in the scan direction, and the displacement between the patch pair 2120 in the line feed direction. The head tilt value, HT, is given by:

$$HT = \tan^{-1} \frac{E}{R \cdot NSD}$$

wherein:

E denotes the displacement between the selected printed patch pairs 2110 in the scan direction;

NSD denotes the nozzle set distance between nozzle set A and nozzle set B as determined from the print head geometry; and R denotes the nominal image resolution given by the imaging device.

Figure 22:
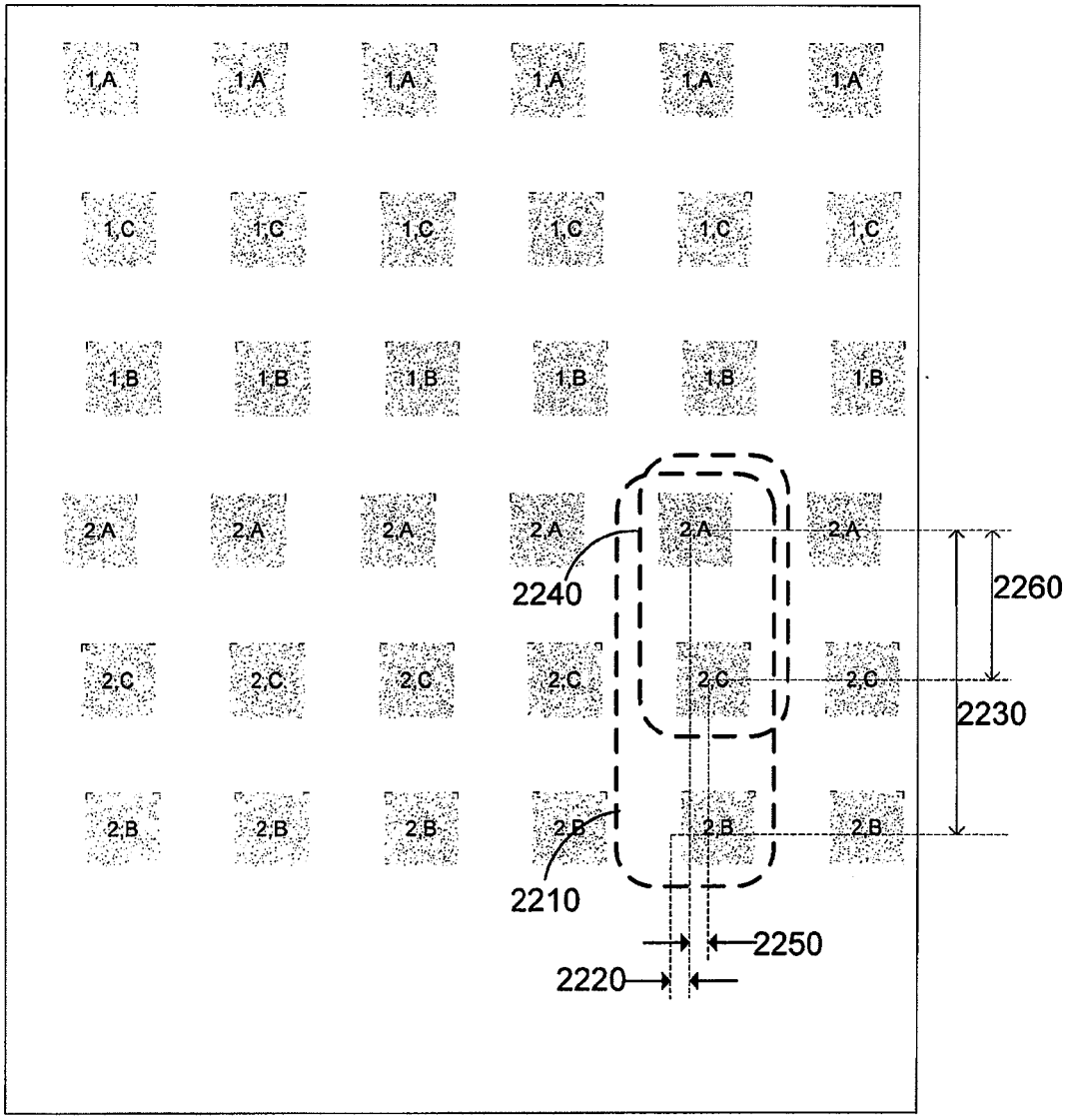
FIG. 22 illustrates an example of the printed chart used for determining inter-nozzle alignment characteristics.

FIG. 22 illustrates an example of the printed chart used for determining the inter-nozzle alignment characteristic of the ink jet printer 15. Inter-nozzle alignment refers to the alignment, in the carriage scan direction, of separate groups of nozzles in the print head. The patches labelled 1 are printed in the first passage. The patches labelled 2 are printed by the subsequent passage of the print head which is separated by an advance of the print medium. The patches labelled A are printed by a set of nozzles, whereas the patches labelled B are printed by a different set of nozzles of the same nozzle group as the first set of nozzles. Patches labelled C are printed by yet another set of nozzles by a different nozzle group, and are separated from the nozzles used to print the patches labelled A and B. In this example the patches labelled A are also used as the indicator patches in the rotation correction step 1820.

Figure 23:
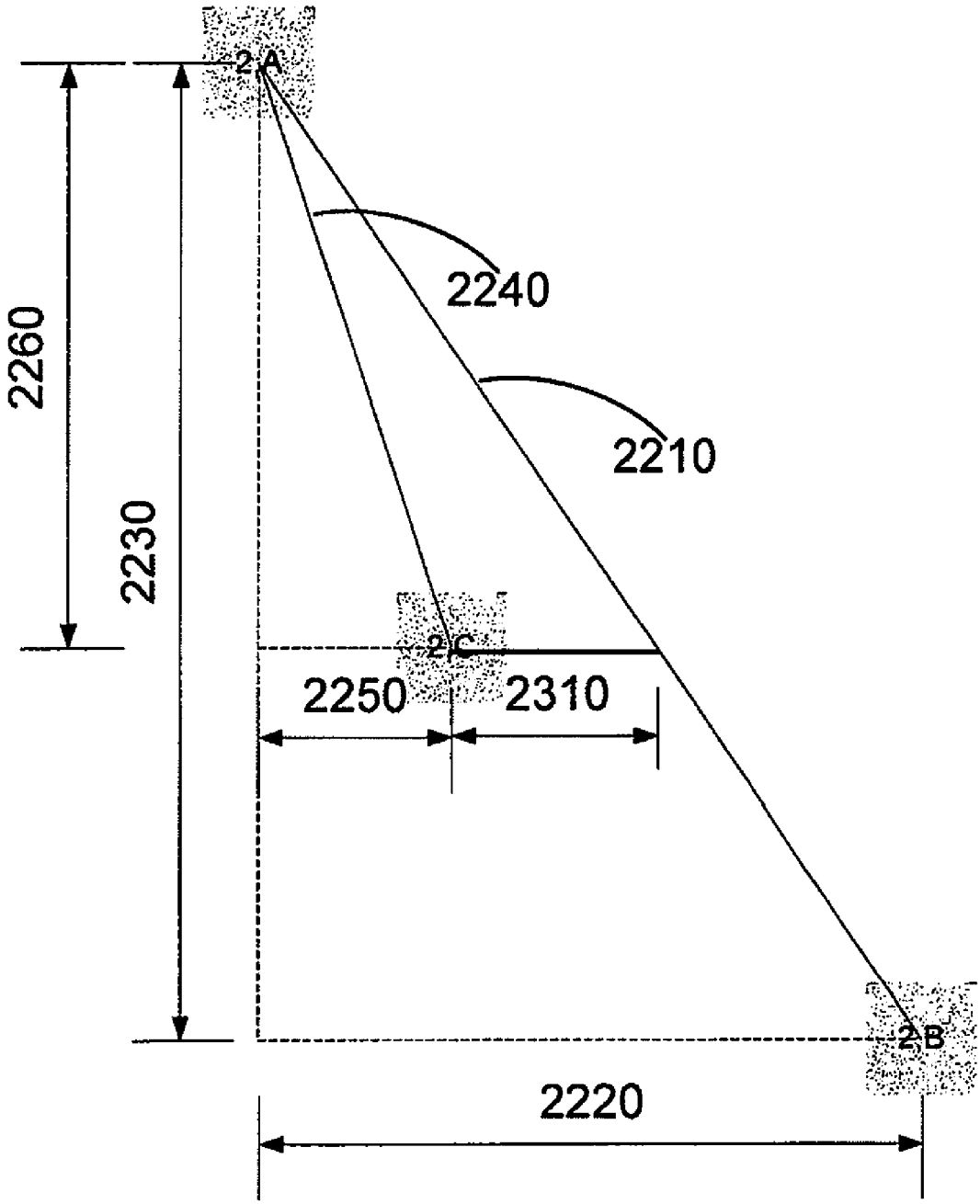
FIG. 23 illustrates an example of the geometry used for determining inter-nozzle alignment characteristics.

The displacements between two patch pairs are required for each inter-nozzle alignment measurement. In FIG. 22 the displacement between pairs 2210 and 2240 are used. The displacement between pairs 2210 consists of a component in the scan direction, 2220, and a component in the medium feed direction, 2230. Similarly, the displacement between pairs 2240 consists of a component in the scan direction, 2250, and a component in the medium feed direction, 2260. FIG. 23 shows a diagram of the displacements between the patch pairs, and their components. The inter-nozzle alignment measurement, HA, labelled as 2310 in FIG. 23, is calculated by:

$$HA = \frac{1}{R}\left(2220\frac{2260}{2230} - 2250\right)$$

wherein:

2220, 2230, 2250, 2260 are the displacements described above; and R denotes the nominal image resolution given by the imaging device.

Determining the Carriage Alignment characteristic of the ink jet printer 15 is next described. Carriage alignment refers to the measurement of alignment of a group of nozzles between the forward passage and the back passage of the print head. This is referred to as bi-directional carriage alignment. Alternatively, this method may be used to measure the alignment of a group of nozzles between consecutive passes of the print head in the same passage direction. This is referred to as uni-directional carriage alignment.

Figure 24:
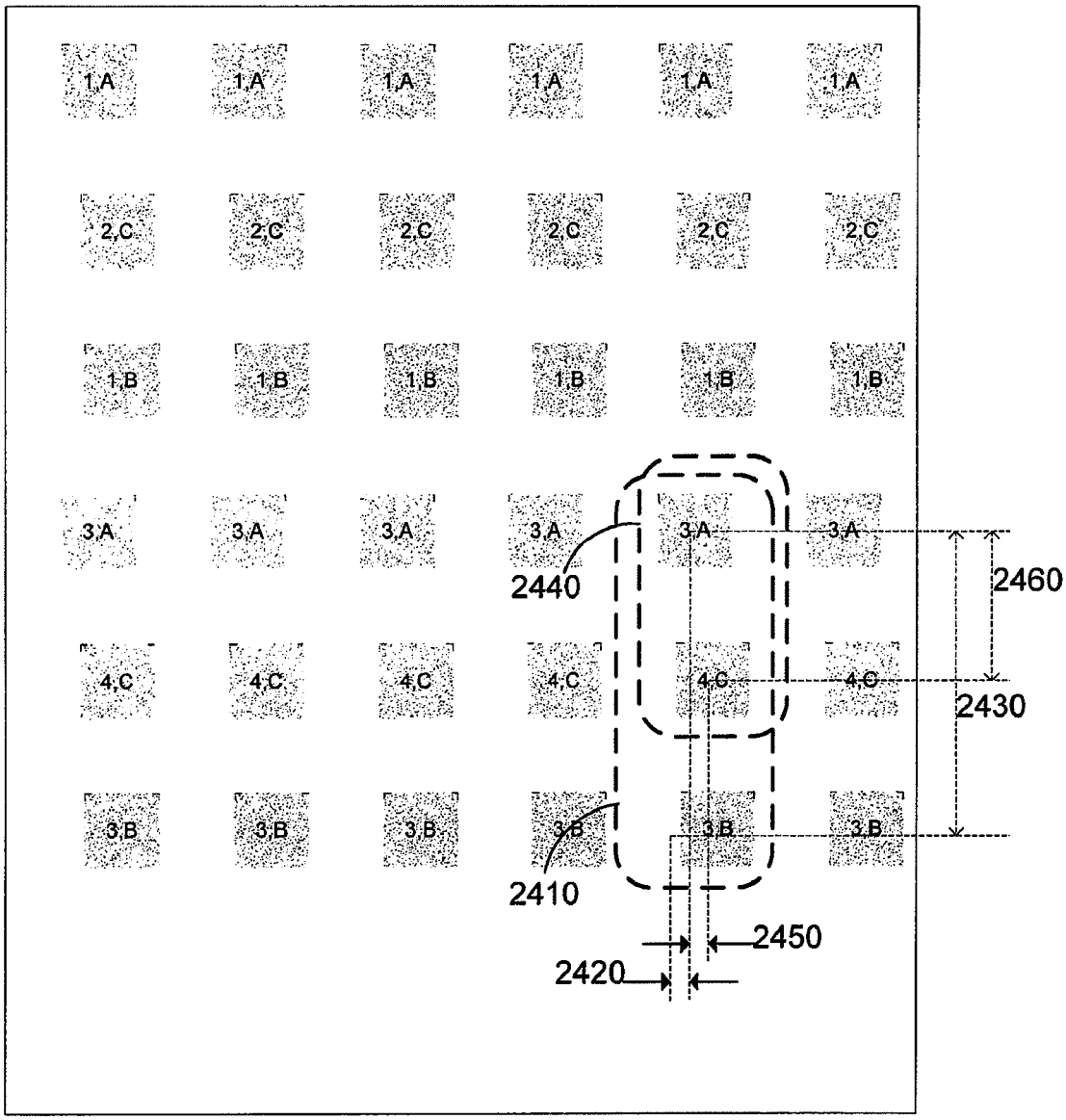
FIG. 24 illustrates an example of the printed chart used for determining carriage alignment characteristics.

FIG. 24 illustrates an example of the printed chart used for determining the carriage alignment characteristics. This chart may be used for both bi-directional and uni-directional carriage alignment. The difference being the carriage passage direction in which particular patches are printed.

For uni-directional alignment, the patches labelled 1 are printed in the first passage. The patches labelled 2 are printed in the second passage with no advance of the print medium. The second passage is printed in the same direction as the first passage. The patches labelled 3 and 4 are printed similarly to the patches labelled 1 and 2, after an advance of the print medium.

For bi-directional alignment, the patches labelled 1 are printed in the first passage. The patches labelled 2 are printed in the second passage with no advance of the print medium. The second passage is printed in the opposite direction as the first passage. The patches labelled 3 and 4 are printed similarly to the patches labelled 1 and 2, after an advance of the print medium.

The patches labelled A are printed by a set of nozzles. Patches labelled B are printed by another set of nozzles of the same nozzle group, and are separated from the nozzles used to print the patches labelled A. Patches labelled C are printed by another set of nozzles of a different nozzle group, and are separated from the nozzles used to print the patches labelled A and B, such that the patches labelled C are in between patches labelled A and B. In this example the patches labelled A are also used as the indicator patches in the rotation correction step 1820.

Figure 25:
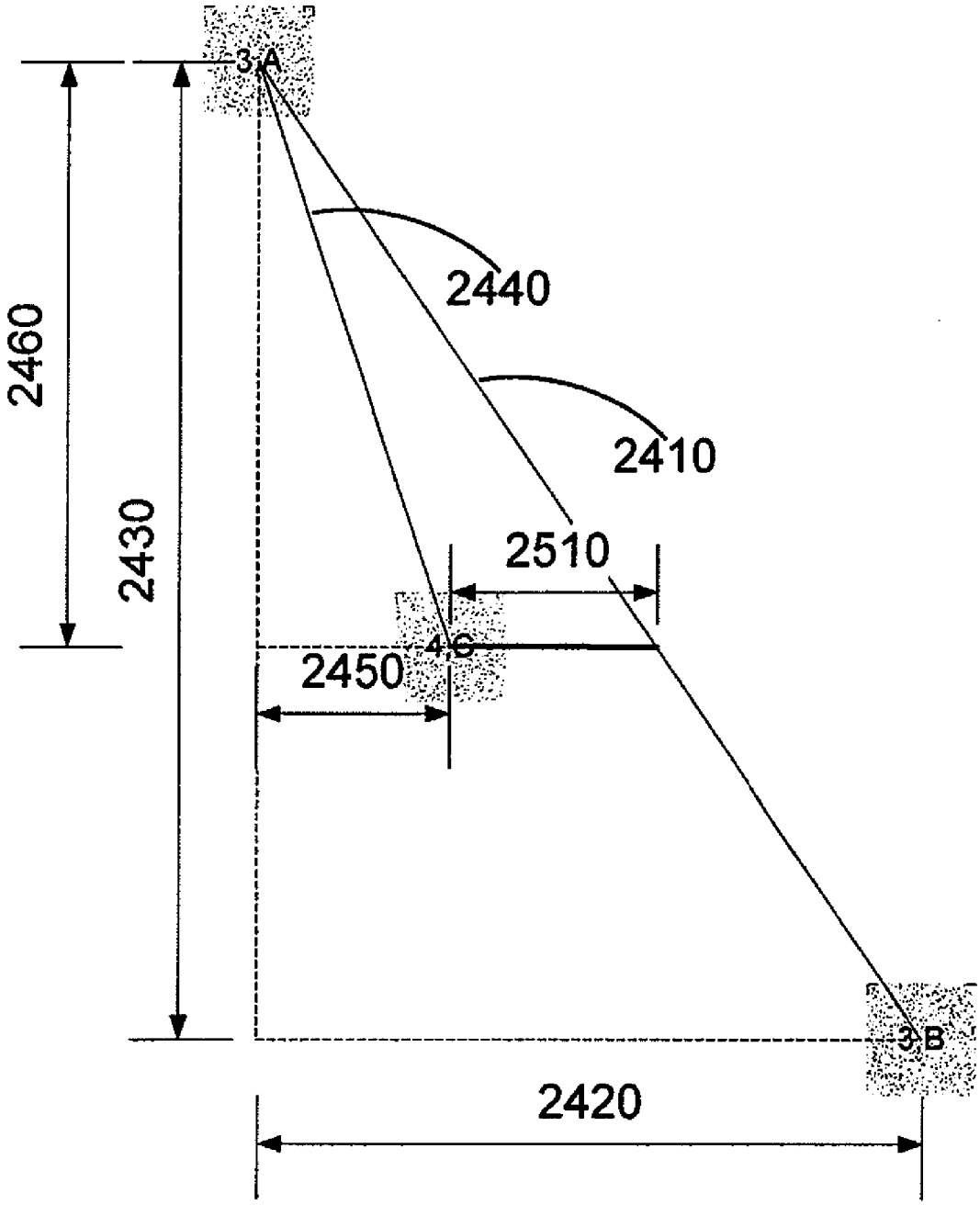
FIG. 25 illustrates an example of the geometry used for determining carriage alignment characteristics.

The displacements between two patch pairs are required for each carriage alignment measurement. In FIG. 24 the displacements between patch pairs 2410 and 2440 are used. The displacement between pair 2410 consists of a component in the scan direction, 2420, and a component in the medium feed direction, 2430. Similarly, the displacement between pair 2440 consists of a component in the scan direction, 2450, and a component in the medium feed direction, 2460. FIG. 25 shows a diagram of the displacements between the patch pairs, and their components. The carriage alignment measurement, CR, labelled as 2510 in FIG. 25, is calculated by:

$$CR = \frac{1}{R}\left(2420\frac{2460}{2430} - 2450\right)$$

wherein:

2420, 2430, 2450, 2460 are the displacements described above;

R denotes the nominal image resolution given by the imaging device.

The foregoing describes only some embodiments of the present invention, and modifications and/or changes can be made thereto without departing from the scope and spirit of the invention, the embodiments being illustrative and not restrictive.

In the context of this specification, the word "comprising" means "including principally but not necessarily solely" or "having" or "including", and not "consisting only of". Variations of the word "comprising", such as "comprise" and "comprises" have correspondingly varied meanings.

The claims defining the invention are as follows:

1. A method of measuring print accuracy of a print mechanism of a printer, the method comprising the steps of:

printing a chart on a print medium using said print mechanism, said chart comprising:

at least a first and a second region printed using first and second sets of nozzles respectively, said first and second sets of nozzles being a predetermined distance apart; and at least a third region printed using said first set of nozzles, wherein the printing of said first and second regions, and the printing of said third region, are separated by a print medium advance operation, and each region comprising a spread spectrum pattern;

imaging said chart to form a chart image;

determining the positions of said regions appearing in said chart image; and calculating the accuracy of the print mechanism of the printer using said predetermined distance, the distance in the direction of said print medium advance operation between said first and second regions, and the distance in the direction of said print medium advance operation between said first and third regions.

2. The method according to claim 1 wherein the ratio of the distance in the direction of said print medium advance operation between said first and second regions and said predetermined distance provides a local scaling factor.

3. The method according to claim 1 wherein said chart includes first, second and third regions at a plurality of locations on said print medium, and said calculating step calculates said accuracy at each location, said method comprises the further step of:

statistically combining said accuracies to provide an overall accuracy.

4. The method according to claim 1 wherein said chart includes first, second and third regions at a plurality of locations on said print medium, and said calculating step calculates said accuracy at each location thereby characterising said accuracy across said print medium.

5. An apparatus for measuring print accuracy of a print mechanism of a printer, the apparatus comprising:

means for printing a chart on a print medium using said print mechanism, said chart comprising:

at least a first and a second region printed using first and second sets of nozzles respectively, said first and second sets of nozzles being a predetermined distance apart; and at least a third region printed using said first set of nozzles, wherein the printing of said first and second regions, and the printing of said third region, are separated by a print medium advance operation, and each region comprising a spread spectrum pattern;

means for imaging said chart to form a chart image;

means for determining the positions of said regions appearing in said chart image; and means for calculating the accuracy of the print mechanism of the printer using said predetermined distance, the distance in the direction of said print medium advance operation between said first and second regions, and the distance in the direction of said print medium advance operation between said first and third regions.

6. A computer readable storage medium, having a program recorded thereon, where the program is configured to make a computer execute a procedure of measuring print accuracy of a print mechanism of a printer, the program comprising:

code for printing a chart on a print medium using said print mechanism, said chart comprising:

at least a first and a second region printed using first and second sets of nozzles respectively, said first and second sets of nozzles being a predetermined distance apart; and at least a third region printed using said first set of nozzles, wherein the printing of said first and second regions, and the printing of said third region, are separated by a print medium advance operation, and each region comprising a spread spectrum pattern;

code for imaging said chart to form a chart image;

code for determining the positions of said regions appearing in said chart image; and code for calculating the accuracy of the print mechanism of the printer using said predetermined distance, the distance in the direction of said print medium advance operation between said first and second regions, and the distance in the direction of said print medium advance operation between said first and third regions.

* * * * *